US006672466B2

(12) United States Patent
Hand

(10) Patent No.: US 6,672,466 B2
(45) Date of Patent: Jan. 6, 2004

(54) TRANSPORTATION SYSTEMS AND METHODS

(76) Inventor: Herbert Hand, 32094-7th Avenue, Mission, British Columbia (CA), V2V 2B1

( * ) Notice: Subject to any disclaimer, the term of this patent is extended or adjusted under 35 U.S.C. 154(b) by 135 days.

(21) Appl. No.: 09/746,704

(22) Filed: Dec. 21, 2000

(65) Prior Publication Data

US 2001/0011514 A1 Aug. 9, 2001

Related U.S. Application Data

(63) Continuation-in-part of application No. 09/471,702, filed on Dec. 23, 1999, now abandoned.

(51) Int. Cl.[7] ..... B66C 21/00

(52) U.S. Cl. ..... 212/76; 212/328; 104/96; 104/130.01

(58) Field of Search ..... 212/76, 77, 328, 212/330, 331; 104/96, 102, 112, 130.01

(56) References Cited

U.S. PATENT DOCUMENTS 834,798 A * 10/1906 Haley
970,032 A * 9/1910 Fitzgerald
1,164,910 A * 12/1915 Ayer
1,708,912 A 4/1929 Alexander
2,055,673 A 9/1936 Smilie
2,987,009 A * 6/1961 Nixon
3,333,713 A 8/1967 Cruciani
3,540,770 A * 11/1970 Mitchell ..... 294/111
4,641,587 A * 2/1987 Dalliard ..... 105/3

FOREIGN PATENT DOCUMENTS

GB 208 * 7/1907 ..... 104/112

* cited by examiner

*Primary Examiner*—Thomas J. Brahan
(74) *Attorney, Agent, or Firm*—Oyen Wiggs Green & Mutala

(57) ABSTRACT

A transportation system for transporting a load into and out of a serviced area. The transportation system comprises near and far support lines and a cross support line suspended from the near and far support lines. A trolley assembly traverses the cross support line, and the trolley assembly is adapted to carry the load from the area to harvested. A transfer track may be used to allow the trolley to traverse the near and/or far support lines.

1 Claim, 21 Drawing Sheets

TRANSPORTATION SYSTEMS AND METHODS

RELATED APPLICATIONS

This is a continuation-in-part of U.S. patent application Ser. No. 09/471,702, which was filed on Dec. 23, 1999 now abandoned.

TECHNICAL FIELD

The present invention relates to transportation systems and methods, and in particular to transportation systems and methods that allow people and material to be efficiently and cost-effectively removed from an area without roads or where roads are overused.

BACKGROUND OF THE INVENTION

The present application has application to any activity that requires the transportation of material and people to and from locations that are not served by roads or where the roads are inadequate or overused. Activities where the present invention may be used include logging, mining, ski lifts, and/or public transportation. The present invention is of particular relevance in the context of logging activities, and that application of the present invention will be described herein in detail with the understanding that the scope of the present invention shall be defined by the claims appended hereto and not the following detailed discussion.

Logging activities often take place in remote, environmentally sensitive areas. For a variety of reasons, it may not be practical to construct an extensive network of roads in logging areas. When timber is harvested in areas not serviced by roads, the use of off-road ground vehicles to remove harvested timber is undesirable in many cases and in other cases may not be possible due to rough terrain.

Timber is often removed from remote logging areas using helicopters. Helicopters can effectively remove timber from logging areas even if the terrain is not navigable by ground vehicles, but the use of helicopters is expensive and thus not practical in many situations.

The need thus exists for relatively inexpensive transportation systems and methods and in particular for such systems and methods that allow the removal of loads from remote, inaccessible areas.

RELATED ART

The following patents were uncovered as the result of a professional patentability search conducted on behalf of the Applicant.

U.S. Pat. No. 3,333,713 to Cruciani illustrates a lifting means that is suspended on cross cables that are in turned suspended from two parallel cables. The cross cables support a load that is movable between the two parallel cables.

U.S. Pat. No. 2,055,673 to Smilie depicts a load carrying trolley that supported by cross cables between two parallel cables.

U.S. Pat. No. 1,708,912 to Alexander discloses a system adapted to drag material from a pile in which the material is disclosed. Parallel cables are arranged on either side of the pile. A scraper is connected to a cross support line that is pulled to move the scraper across the pile.

SUMMARY OF THE INVENTION

The present invention may be implemented in a transportation system comprising a near support line, a far support line, a cross support line, a far block for movably connecting the cross support line to the far support line, a near block for movably connecting the cross support line to the near support line, and a trolley assembly for traversing the cross support line. The load to be removed is carried by the trolley along the cross support line to a location that allows transportation along existing roads.

The system may optionally comprise a transfer track that allows the trolley to move between the cross support line and the near support line. The trolley may thus transport the load not only along the cross support line between the near and far support lines but to one end of the near support line.

The coupling block may be a double block through which the cross support line extends. The end of the cross support line opposite the far block can be pulled by a truck, reel, or other mechanism to move the coupling block and to reduce slack in the cross support line should the near and far support lines not be parallel. A system using a cross support line that extends through the coupling block may optionally comprise a snubber line connected to the near block to fix a location of the near block along the near support line.

The trolley may optionally comprises a structural assembly and first and second rollers that engage one of the support lines to suspend the structural assembly from the support line. Optionally, mounted on the structural assembly is an electric motor that powers one of the rollers to cause the trolley to move along the support line from which it is suspended. A hoist assembly may optionally be mounted on the structural assembly to allow the load to be raised and lowered relative to the trolley.

The load may optionally be containerized at the point of harvest. The container will be transported by the trolley and loaded on a truck to minimize handling of the load.

BRIEF DESCRIPTION OF THE DRAWINGS

FIGS. 4 and 5 are top plan views depicting third and fourth embodiments of transportation systems similar to the first and second embodiments but adapted to use an optional transfer track constructed in accordance with the present invention;

DETAILED DESCRIPTION OF THE PREFERRED EMBODIMENTS

The basic concept of the present invention may be embodied in any one of a number of configurations. Several exemplary embodiments of the present invention will be described below, with the understanding that these embodiments illustrate the scope of the present invention but are not intended to be an exhaustive description of all scenarios in which the present invention may be used.

I. First Embodiment

Figure 1:
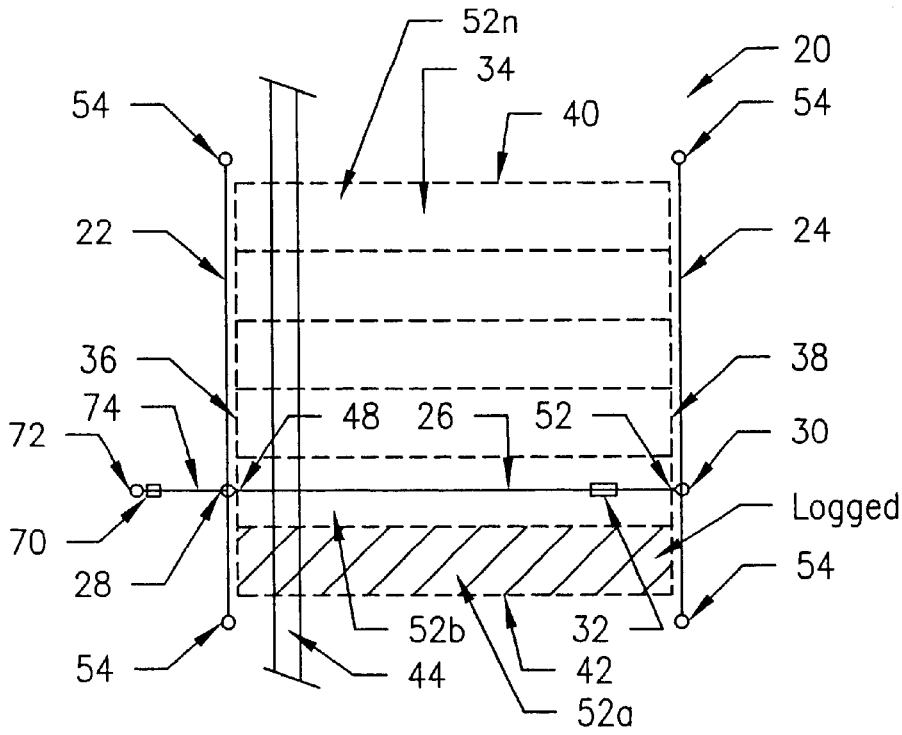
FIGS. 1 and 2 are top plan views depicting a transportation system constructed in accordance with, and embodying, the principles of a first embodiment of the present invention.
Figure 2:
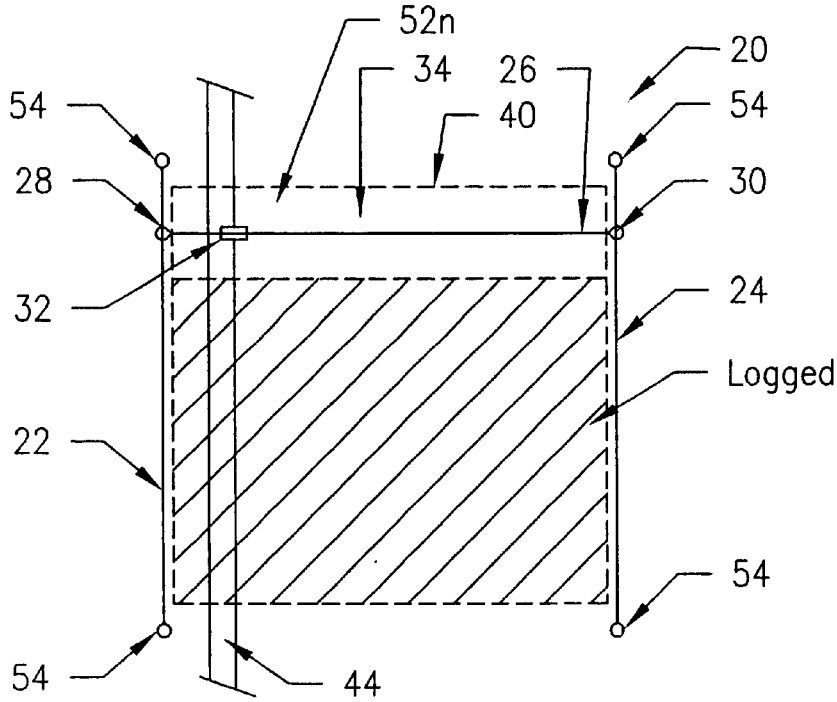

Referring initially to FIGS. 1 and 2, depicted therein is an exemplary transportation system 20 containing components and implementing methods that, in varying combinations and sub-combinations, may be constructed in accordance with, and embody, the principles of a first embodiment of the present invention.

The exemplary transportation system 20 comprises a near support line 22, a far support line 24, a cross support line 26, a near block 28, a far block 30, and a trolley 32. The transportation system 20 is installed to allow removal of raw timber from an exemplary area 34 to be logged. The logging area 32 is defined by near and far side edges 36 and 38 and near and far end edges 40 and 42.

In the exemplary logging area 34, a road 44 extends along the near opposing edge 36 between the near and far end edges 40 and 42. Accordingly, at least a portion of the logging area 34 is directly accessible by a vehicle such as a truck. The road 44 is for illustrative purposes only, and methods of transporting raw lumber for additional processing other than road and truck may be employed. For example, the road 44 may also be a river down which raw or a railroad over which raw timber may be transported. The road may also be a landing strip or helicopter landing area that allows raw timber to be removed by air.

The near and far support lines 22 and 24 are supported above the ground along the near and far opposing side edges 36 and 38 of the logging area 34. The near and far blocks 28 and 30 are supported by the near and far support lines 22 and 24, respectively. The cross support line 26 is rigidly connected at a near end 48 to the near block 28 and at a far end 50 to the far block 30. The blocks 28 and 30 move relative to the near and far support lines 22 and 24 along the near and far side edges 36 and 38 of the logging area 34.

The trolley 32 is suspended from the cross support line 26. The trolley 32 traverses the cross support line 26 between the near and far support lines 22 and 24, and thus between the near and far side edges 36 and 38 of the logging area 34.

Raw timber is removed from the exemplary logging area 40 in the following manner. Initially, the near and far blocks 28 and 30 and cross support line 26 are arranged adjacent to the far end edge 42 of the logging area 34. The near and far blocks 28 and 30 are then fixed relative to the near and far support lines 36 and 38 so that the cross support line 26 is fixed relative to the support lines 36 and 38. The trolley 32 is then used to transport materials between the road 44 and a portion of the logging area 34. In particular, in this position the system 20 allows access to a swath 52*a* of the logging area 34 that extends on either side of the cross support line 26. The dimensions of the swath 52*a* are determined by the distance from the cross support line 26 that can be reasonably traversed by foot when hauling raw timber to the trolley 32.

The near and far blocks 28 and 30 are then moved to and locked in a new position such that the cross support line 26 is spaced from the far end edge 42. A new swath 52*b* of the logging area 34, which abuts or slightly overlaps the original swath 52*a*, may now be accessed by the system 20. This process is repeated until a final swath 52*n* of the logging area 40 is accessed by the system 20.

Material may thus be transported into and out of the entire logging area 40 without building additional roads or using off-road vehicles or helicopters.

With the foregoing general understanding of the first embodiment of the present invention in mind, certain implementation details of this first embodiment will now be described. The following detailed explanation of this first embodiment is intended to allow one of ordinary skill in the art to make and use the present invention and should not be used to limit the scope of the claims appended hereto.

FIG. 1 illustrates that the transportation system 20 comprises first and second spar trees 54 that support each end of the near and far support lines 22 and 24. The spar trees 54 may be existing tree stumps that are capable of elevating the ends of the support lines 22 and 24 and withstanding the loads necessary to maintain these lines 22 and 24 suspended above the ground. Other structures such as metal columns may be used as the spar trees if appropriate. Guy wires may be used in a conventional manner to stabilize the spar trees 54. FIG. 1 also depicts a snubbing line 56 that is preferably used to fix a position of the near block 28 along the near support line 22.

The dimensions of the exemplary logging area 34 are substantially defined by the lengths of the near and far support lines 22 and 24 and the cross support line 26. The lengths of these support lines 22–26 will be defined by the load carrying capacities of the support lines and the means, such as spar trees, for supporting these lines. The length of these lines may be extended by supporting the lines at intermediate points between their ends using C-clamp assemblies to support the cables at the intermediate points. The support lines 22–26 and logging area 34 are thus exemplary and other arrangements for maintaining the support lines 22–26 above the ground may be used.

The system 20 of FIG. 1 may be enhanced by the use of radio control to operate the trolley assembly 32. The operator can stand at one location as the trolley assembly 32 moves along its path and need not walk along with the trolley assembly.

To anchor the near block 28 at a desired location, a power saw winch 70 may be fixed to a member such as a stump 72. The power saw winch 70 is connected to an anchor line 74 and operated to take up slack in the line 74, thereby preventing movement of the block 28 along the near side support line 22.

II. Second Embodiment

Figure 3:
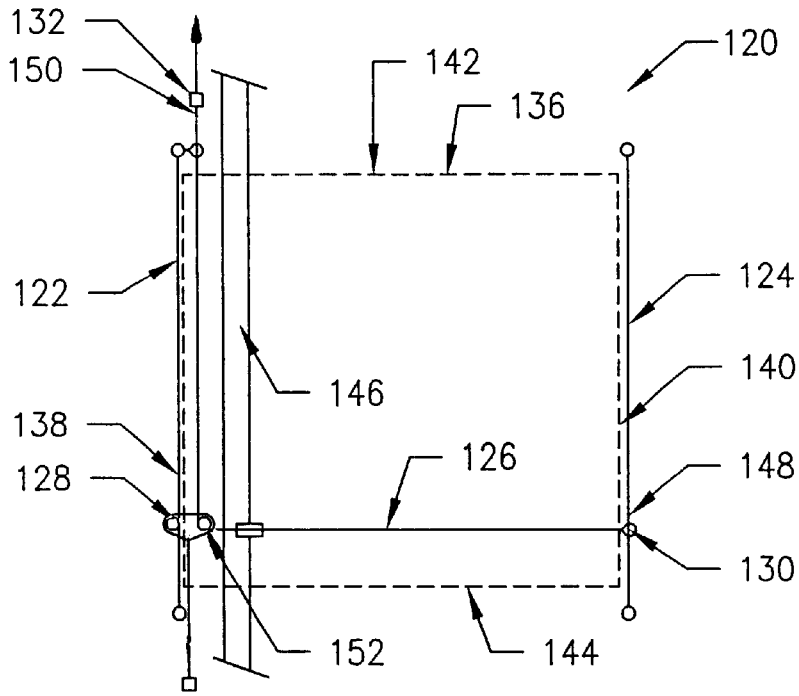
FIGS. 3 and 4 are top plan views depicting a transportation system constructed in accordance with, and embodying, the principles of a second embodiment of the present invention.
Figure 4:
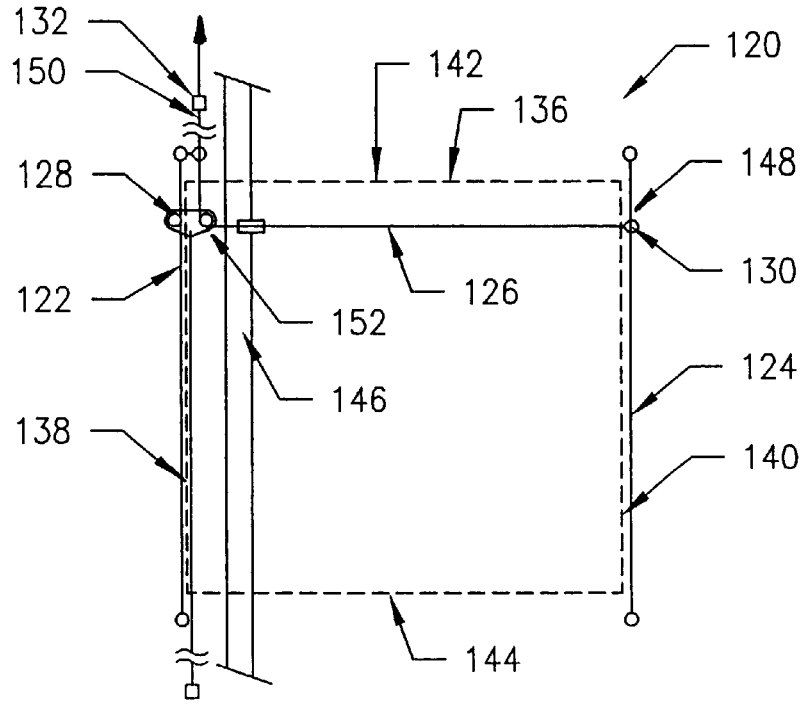

Referring now to FIGS. 3 and 4, depicted therein is an exemplary transportation system 120 containing components and implementing methods that, in varying combinations and sub-combinations, may be constructed in accordance with, and embody, the principles of a second embodiment of the present invention.

Like the system 20 described above, the exemplary transportation system 120 comprises a near support line 122, a far support line 124, a cross support line 126, a near block 128, a far block 130, and a trolley 132. The system 120 further comprises a truck 134. The exemplary transportation system 120 allows removal of raw timber from an exemplary area 136 to be logged.

Like the logging area 36 described above, the logging area 136 is defined by near and far side edges 138 and 140 and near and far end edges 142 and 144 and a road 146 extends along the near side edge 138 between the near and far end edges 142 and 144. Again, the road 146 may represent other types of transportation such as by river, railroad, air, and the like. And as with the system 20 described above, the near and far support lines 122 and 124 are supported along the near and far opposing edges 138 and 140, and the near and far blocks 128 and 130 are supported by the near and far support lines 122 and 124, respectively. The cross support line 126 is rigidly connected at a far end 148 to the far block 130.

However, the near block 128 differs from the near block 28 of the system 20 in that the near block 128 is a double block, and the cross support line 126 also passes through the near block 128. A near end 150 of the cross support line 126 is connected to the truck 132. The near block 128 thus supports an intermediate portion 152 of the cross support line 126 that is spaced along the line 126 between the far and near ends 148 and 150.

As with the system 120 described above, the blocks 128 and 130 move relative to the near and far support lines 122 and 124 along the near and far side edges 136 and 138 of the logging area 136. Unlike the system 20, however, the cross support line 126 and near block 128 move relative to each other such that the truck 132 can pull on the near end 150 of the cross support line 26 to adjust the tension thereon.

The ability to adjust the tension of the cross support line 126 allows the system 120 to tolerate having the near and far support lines 122 and 124 extend at an angle to each other. As the near and far support lines 122 and 124 converge and thus reduce the distance between the near and far blocks 128 and 130, the truck 132 is operated to take up any slack in the cross support line 126. If the distance between the support lines 122 and 124 increases as the blocks 128 and 130 are moved, the truck 132 can be operated to release the tension on the cross support line 126.

The trolley 134 is suspended from the cross support line 126 and traverses the cross support line 126 and thus moves between the near and far side edges 136 and 138 of the logging area 134.

Using the system 120, raw timber is removed from the exemplary logging area 134 in the same basic manner as discussed above with reference to the system 20. Multiple swaths 154 are serviced by the cross support line 126 to allow access to the entire area 134 to be logged. The primary difference in the method of using the two systems 20 and 120 is that, with the system 120, the connection of the cross support line 126 to the truck 132 allows the tension on the cross support line 126 to be adjusted as the line 126 moves between the near and far end edges 142 and 144.

III. Third Embodiment

Figure 5:
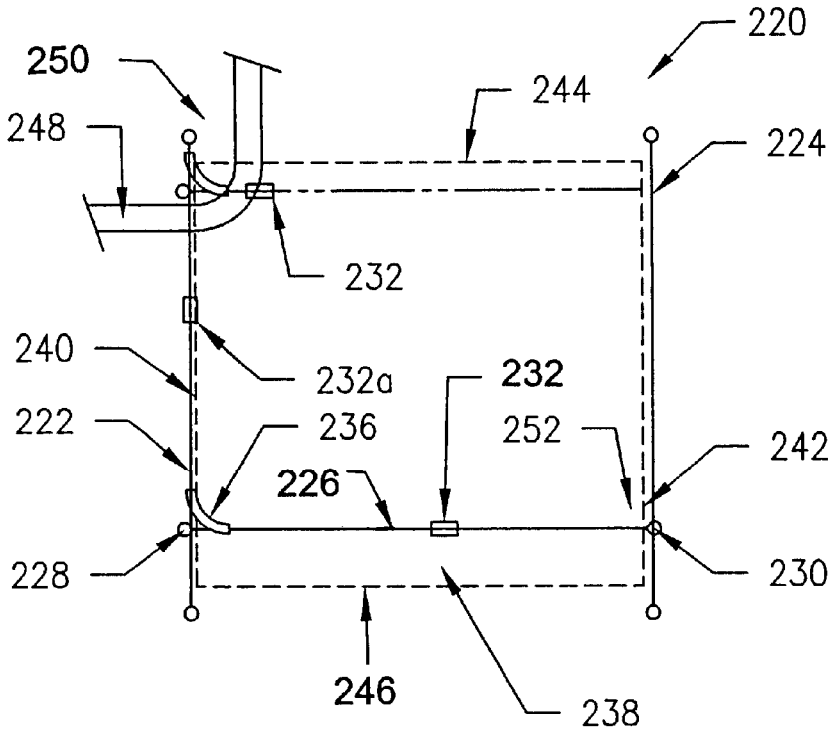

Depicted in FIG. 5 is an exemplary transportation system 220 containing components and implementing methods that, in varying combinations and sub-combinations, may be constructed in accordance with, and embody, the principles of a third embodiment of the present invention.

Like the systems 20 described above, the exemplary transportation system 220 comprises a near support line 222, a far support line 224, a cross support line 226, a near block 228, a far block 230, and a trolley 232. The system 220 further comprises a transfer track 236 that, as will be discussed in detail below, allows the trolley 232 to move between the cross support line 226 and the near support line 222.

The exemplary transportation system 120 allows removal of raw timber from an exemplary area 238 to be logged.

Like the logging area 36 described above, the logging area 238 is defined by near and far side edges 240 and 242 and near and far end edges 244 and 246.

Unlike the logging area 36, a road does not extend along the entire near opposing edge 240 between the near and far end edges 244 and 246. Instead, the logging area 236 is accessed by a road 248 that extends only through a corner portion 250 of the logging area 238 where the near side edge 240 and near end edge 244 meet. Again, the road 248 may be a river, railroad, air strip or the like. The road 248 at the corner 250 may also represent a helicopter landing pad at which raw timber may be stored for removal by helicopter. The combination of the system 220 and helicopter removal may be more cost effective than removal by helicopter alone.

As with the system 20 described above, the near and far support lines 222 and 224 are supported along the near and far opposing edges 240 and 242, and the near and far blocks 228 and 230 are supported by the near and far support lines 222 and 224, respectively. The cross support line 226 is rigidly connected at a far end 252 to the far block 230. Further, the blocks 228 and 230 of the system 220 move relative to the near and far support lines 222 and 224 along the near and far side edges 240 and 242 of the logging area 238.

The trolley 232 is suspended from the cross support line 226 and moves between the near and far side edges 240 and 242 of the logging area 238.

The transfer track 236 is a rigid metal member or assembly that engages the cross support line 226 and the near support line 222 such that the trolley 232 can move between these lines 226 and 222. The details of the transfer track 236 are determined by the manner in which the trolley 232 engages the support lines 222 and 226. An exemplary trolley and exemplary transfer track designed therefor will be described in detail below. The present invention as claimed in its broadest form is not, however, intended to be limited to the type of trolley and transfer track described herein.

Using the system 220, raw timber is removed from the exemplary logging area 238 in the same basic manner as discussed above with reference to the system 20 described above. Multiple swaths are serviced by the cross support line 226 to allow access to the entire area 238 to be logged.

The primary difference in the method of using the system 220 as opposed to that of the system 20 described above is that, with the system 220, the transfer track 236 allows the trolley 232 to move along the near support line 222 as well as between the near and far support lines 222 and 224 on the cross support line 226. This allows the trolley 232 (as shown by reference character 232*a*) to move to the corner 250 of the logging area 238 where the road 248 is located even if the cross support line 226 is adjacent to the far end edge 246 of the logging area 238. The logging area 238 may thus be defined at a location where only a very small portion of the area 238 is accessible by road, river, railroad, or the like.

IV. Fourth Embodiment

Figure 6:
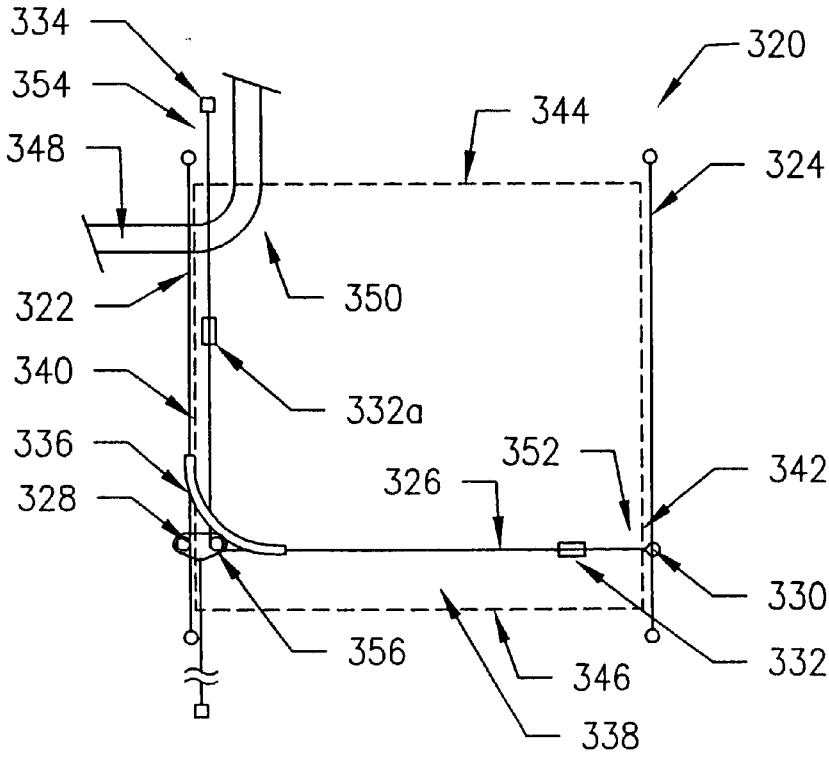

Depicted in FIG. 6 is an exemplary transportation system 320 containing components and implementing methods that, in varying combinations and sub-combinations, may be constructed in accordance with, and embody, the principles of a third embodiment of the present invention.

Like the system 120 described above, the exemplary transportation system 320 comprises a near support line 322, a far support line 324, a cross support line 326, a near block 328, a far block 330, and a trolley 332. Like the system 120, the system 320 further comprises a truck 334. Like the system 220 of the third embodiment, the system 320 also comprises a transfer track 336 that allows the trolley 332 to move between the cross support line 326 and the near support line 322.

The exemplary transportation system 320 allows removal of raw timber from an exemplary area 338 to be logged.

The logging area 238 is defined by near and far side edges 340 and 342 and near and far end edges 344 and 346. The logging area 336 is accessed by a road 348 that extends only through a corner 350 of the logging area 338 where the near side 340 and near end edge 344 meet. Again, the road 348 may be a river, railroad, air strip or the like or may also represent a helicopter landing pad at which raw timber may be stored for removal by helicopter.

As with the systems 20, 120, and 220 described above, the near and far support lines 322 and 324 are supported along the near and far opposing edges 340 and 342, and the near and far blocks 328 and 330 are supported by the near and far support lines 322 and 324, respectively. The cross support line 326 is rigidly connected at a far end 352 to the far block 330. The near block 328 is, like the near block 128 of the system 120, a double block. The cross support line 326 thus also passes through the near block 328, and a near end 354 of the cross support line 326 is connected to the truck 332. The near block 328 thus supports an intermediate portion 356 of the cross support line 326 that is spaced between the far and near ends 352 and 354 thereof.

As with the system 20 and 120 described above, the blocks 328 and 330 of the system 320 move relative to the near and far support lines 322 and 324 along the near and far side edges 340 and 342 of the logging area 338. And like the system 120, the cross support line 326 and near block 328 move relative to each other such that the truck 334 can pull on the near end 354 of the cross support line 326 to adjust the tension thereon. The ability to adjust the tension of the cross support line 326 allows the near and far support lines 322 and 324 to be at an angle to each other.

The trolley 332 is suspended from the cross support line 326 and moves between the near and far side edges 340 and 342 of the logging area 338.

The transfer track 336 is, like the member 236 described above, a rigid metal member or assembly that engages the cross support line 326 and the near support line 322 such that the trolley 332 can move between these lines 326 and 322. The details of the transfer track 236 are determined by the manner in which the trolley 232 engages the support lines 222 and 226. An exemplary trolley and exemplary transfer track designed therefor will be described in detail below. The present invention as claimed in its broadest form is not, however, intended to be limited to the type of trolley and transfer track described herein.

Using the system 320, raw timber is removed from the exemplary logging area 338 in the same basic manner as discussed above with reference to the system 120 described above. Multiple swaths are serviced by the cross support line 326, which is moved between the logging area end edges 344 and 346 to allow access to the entire area 338 to be logged.

The transfer track 336 allows the trolley 332 to move along the near support line 322 as well as between the near and far support lines 322 and 324 on the cross support line 326. This allows the trolley 332 (as shown by reference character 332*a*) to move to the corner 350 of the logging area 338 where the road 348 is located when the cross support line 326 is adjacent to the far end edge 346 of the logging area 338. The logging area 338 may thus be defined at a location where only a very small portion of the area 338 is accessible by road, river, railroad, or the like.

V. The Exemplary Transfer Track

Figure 8:
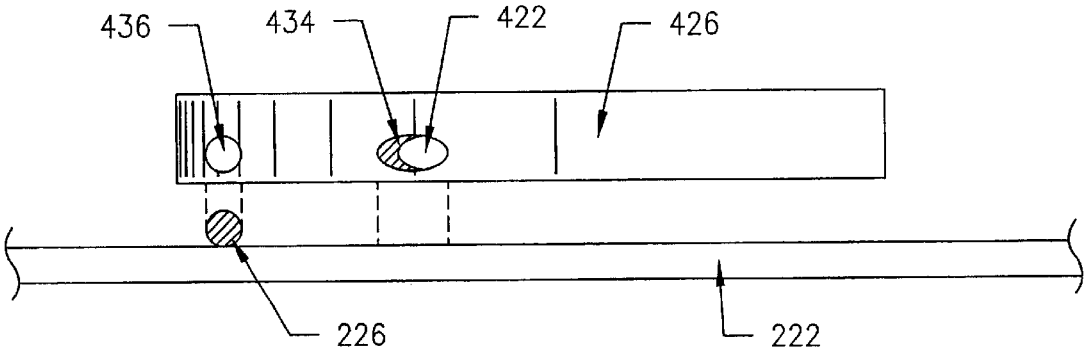
FIG. 8 is a side elevation exploded view depicting how the exemplary transfer track of FIG. 6 is adapted to be mounted on the near and cross support lines.
Figure 7:
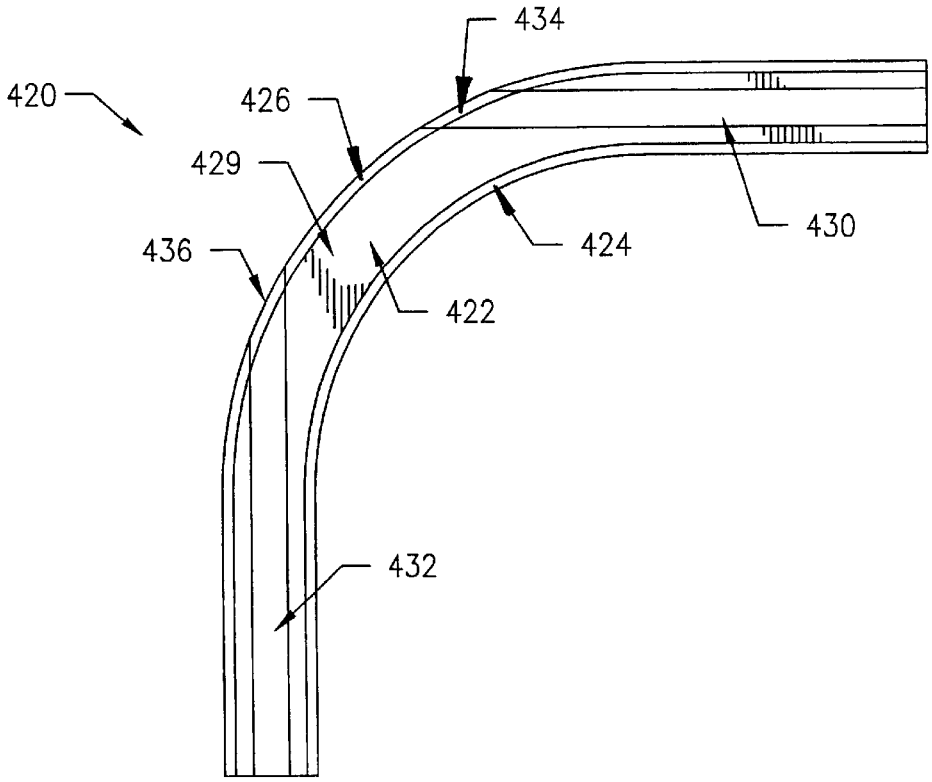
FIG. 7 is a top plan view of an exemplary transfer track that may be used as shown in FIGS. 4 and 5.
Figure 9:
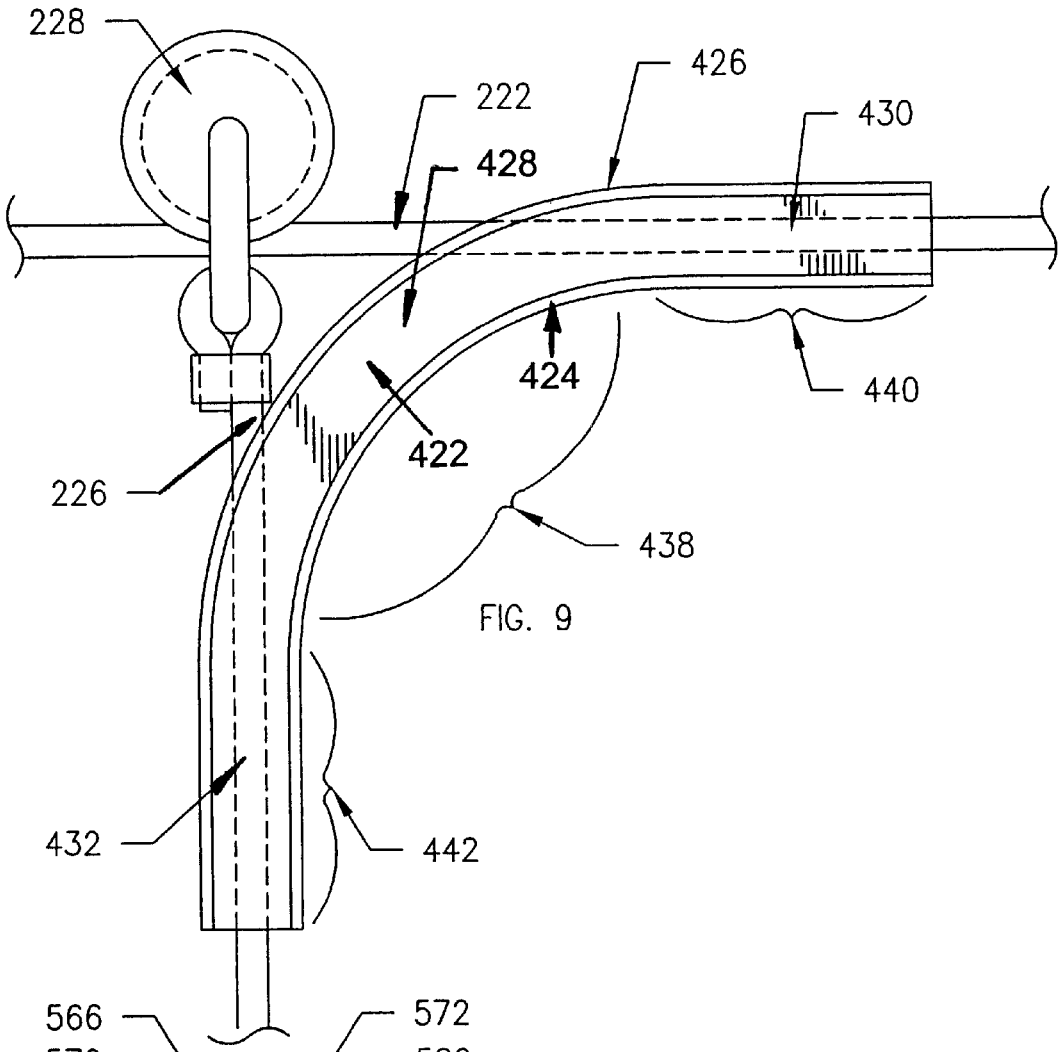
FIG. 9 is a top plan view depicting the exemplary transfer track of FIG. 6 mounted on near and cross support lines.

Referring now to FIGS. 7, 8, and 9, depicted at 420 therein is an exemplary transfer track 420 that may be used as the transfer tracks 236 and 336 schematically depicted above.

The transfer track 420 is a generally arcuate member comprising a channel plate 422 and inner and outer flanges 424 and 426. The channel plate 422 and flanges 424 and 426 define upper and lower trolley channels 428 (FIG. 9) and 429 (FIG. 7). And as shown in FIG. 7, first and second support line channels 430 and 432 are formed in the channel plate 422 within the lower trolley channel 429. FIGS. 7 and 8 show that first and second notches or openings as indicated by reference characters 434 and 436 are formed in the outer flange 424 in alignment with the line channels 430 and 432, respectively.

FIG. 9 depicts the transfer track 420 being used as the transfer track 236 of the system 220. The transfer track 420 can clearly be used as the transfer track 336 of the system 320, but only the use of the track 420 with the system 220 will be described herein in the interests of brevity.

The near support line 222 is received by the first line channel 430 and extends through the first opening 434 in the outer flange 424. The cross support line 226 is received by the second line channel 432 and extends through the second opening 436 in the flange 424.

The angle at which the near and cross support lines 222 and 226 extend relative to each other thus defines the angle at which the line channels 430 and 432 extend relative to each other. Desirably, the angle between the support lines 222 and 226 will be as close as possible to ninety degrees. In practice, this angle will likely vary several degrees from the desired ninety degrees. The angle between the channels 430 and 432 will thus be a right angle, but the channels 430 and 432 may be oversized, tapered, and or lined with resilient material so that the transfer track 420 will tolerate variations in the angle between the support lines 222 and 226.

As shown in FIG. 9, the transfer track 420 thus comprises an arcuate portion 438 and first and second straight portions 440 and 442. The arcuate portion 438 turns the trolley channel 428 through an angle of ninety degrees, while the straight portions 440 and 442 extend a short distance along the support lines 222 and 226, respectively. The support lines 222 and 226 thus support the transfer track 420 at the juncture between these lines 222 and 226.

VI. The Exemplary Trolley Assembly

Figure 10:
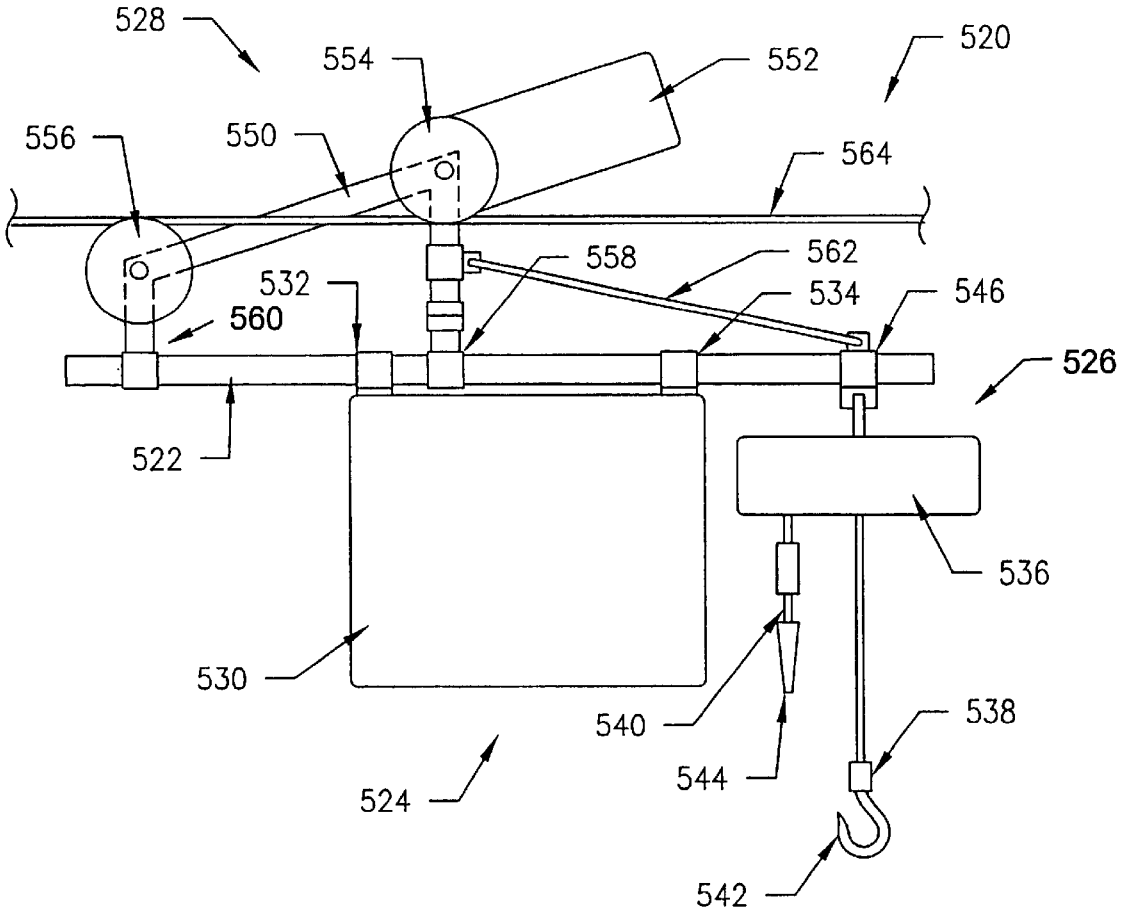
FIG. 10 is a side elevation view depicting an exemplary trolley that may be used with the transportation systems depicted in FIGS. 1–5.

Referring now to FIG. 10, depicted therein is a trolley assembly 520 that may be used as any of the trolleys 32, 132, 232, or 332 of the systems 20, 120, 220, and 320 described above. Other trolley assemblies may be used, but the trolley assembly 520 is particularly suited for use with the support lines and transfer tracks described above.

The trolley assembly 520 comprises a main structural beam 522, a generator assembly 524, a hoist assembly 526, and a drive assembly 528. The main structural beam 522 is simply a rigid member such as a tube or I-beam capable of supporting the loads that will be described below.

The generator assembly 524 comprises a generator enclosure 530 containing a gas-fired electrical generator. A suitable electrical generator is a 6 Hp Honda generator with AC motor control. Such a generator is rated to generate 4500 Watts of power. The generator enclosure 530 is rigidly connected to the beam 522 at first and second connecting locations 532 and 534.

The hoist assembly 526 comprises an electric hoist 536 from which is suspended a hoist cable 538 and a control cable 540. The hoist assembly 526 is conventional in that the operator can raise and lower a hook 542 attached to the hoist cable 538 using a control station 544 connected to the control cable 540. The electric hoist 536 contains an electric motor that is operatively connected to the generator of the generator assembly 524. The hoist assembly 526 is rigidly connected to the beam 522 at a third connecting location 546.

The drive assembly 528 comprises a drive structural member 550, a drive motor 552, and upper and lower drive wheels 554 and 556. The drive structural member 550 is a rigid member that is generally in the shape of an inverted U. The drive structural member 550 is rigidly connected at fourth and fifth connecting locations 558 and 560 to the beam 522.

The drive motor 552 is mounted on the drive structural member 550 and is operatively connected to rotate the upper drive wheel 554. The drive motor 552 is an electrically powered motor that is operatively connected to the generator of the generator assembly 524.

A cable 562 extends between the drive structural member 550 above the fourth connecting point 558 and the main beam 522 at the third connecting point 546.

The first and second drive wheels 554 and 556 are rotatably connected to the drive structural member 550 such that a bottom of the first drive wheel 554 is at about the same level as the top of the second drive wheel 556 when the beam 522 is substantially horizontal. Further, the wheels 554 and 556 are aligned with each other such that they rotate in substantially the same plane. Thus, as shown in FIG. 10, in use a support line 564 passes under the first drive wheel 554 and over the second drive wheel 556 such that the beam 522 will be slightly nose down when supported by the support line 564 and substantially parallel when supported on the transfer track.

The first through fifth connecting points are arranged such that a downward force is always applied to the first drive wheel 554 and an upward force is always applied to the second drive wheel 556. Thus, under normal conditions, the loads carried by the beam 522 will ensure that the drive wheels 554 and 556 are always held in contact with the support line 564.

To remove the trolley assembly 520 from the support line 564, the beam 522 is raised near the third connecting point, which allows the second wheel 556 to disengage from the support line 564, at which point the trolley assembly may be lifted from the support line 564.

Figure 11:
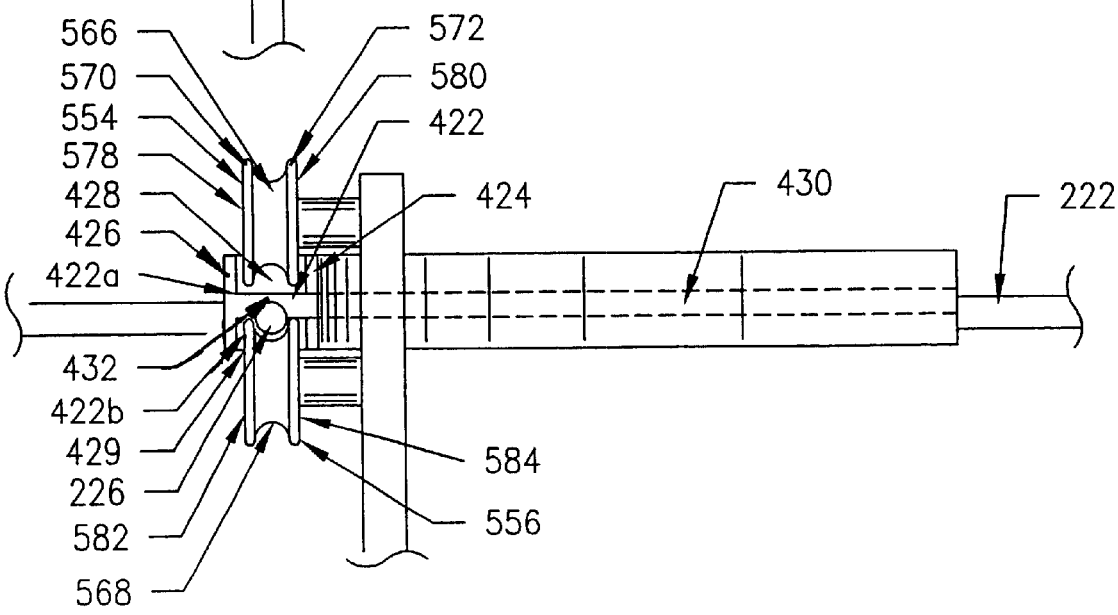
FIG. 11 is an end elevation view depicting the exemplary trolley of FIG. 9 traversing the transfer track of FIGS. 6–8.

FIG. 11 depicts the transfer track 420 supporting the trolley assembly 520. The upper drive wheel 554 travels along the upper trolley channel 428 and the lower drive wheel 556 travels along the lower trolley channel 429.

FIG. 11 also shows that the drive wheels define annular inwardly curved bearing surfaces 566 and 568 that prevent the wheels from moving sideways relative to the support line when supported thereby.

The drive wheels 554 and 556 each define a pair of annular cylindrical bearing surfaces 570, 572 and 574, 576 that engage upper and lower surfaces 422*a* and 422*b* of the channel plate 422 when the trolley assembly 520 is carried by the transfer track 420. In this case, sides 578, 580 and 582, 584 of the drive wheels 554 and 556 engage the track member flanges 424 and 426 to prevent to prevent sideways movement of the drive wheels relative to the transfer track 420.

The drive wheels 554 and 556 thus engage, are supported by, and travel along the support line when the trolley assembly 520 is spaced from the transfer track 420. As the trolley assembly 520 approaches the transfer track 420, the leading one of the upper and lower drive wheels 554 and 556 will engage the transfer track 420 and enter its corresponding upper or lower trolley channels 428, 429. Continued movement of the trolley assembly 520 will cause the trailing one of the upper and lower drive wheels 554 and 556 will engage the transfer track 420 and enter its corresponding upper or lower trolley channels 428, 429.

The straight portions 440 and 442 of the transfer track 420 should be long enough for both of the drive wheels 554 and 556 to enter their corresponding trolley channels 428 and 429 before the transfer track 420 beings to turn the trolley assembly 520. After both drive wheels 554 and 556 engage the transfer track 420, the trolley assembly 520 will then turn through the ninety degree angle defined by the curved portion 438 of the transfer track. The second of the straight portions 440 and 442 encountered will then align the trolley assembly 520 with the support line to which the trolley assembly 520 is being transferred.

As the trolley assembly 520 leaves the transfer track 420, the leading one of the upper and lower drive wheels 554 and 556 will leave its corresponding upper or lower trolley channels 428, 429 and engage and be supported by the new support line. Continued movement of the trolley assembly 520 will cause the trailing one of the upper and lower drive wheels 554 and 556 to leave its corresponding upper or lower trolley channel 428, 429 and engage the new support line.

VII. Fifth Embodiment

Figure 12:
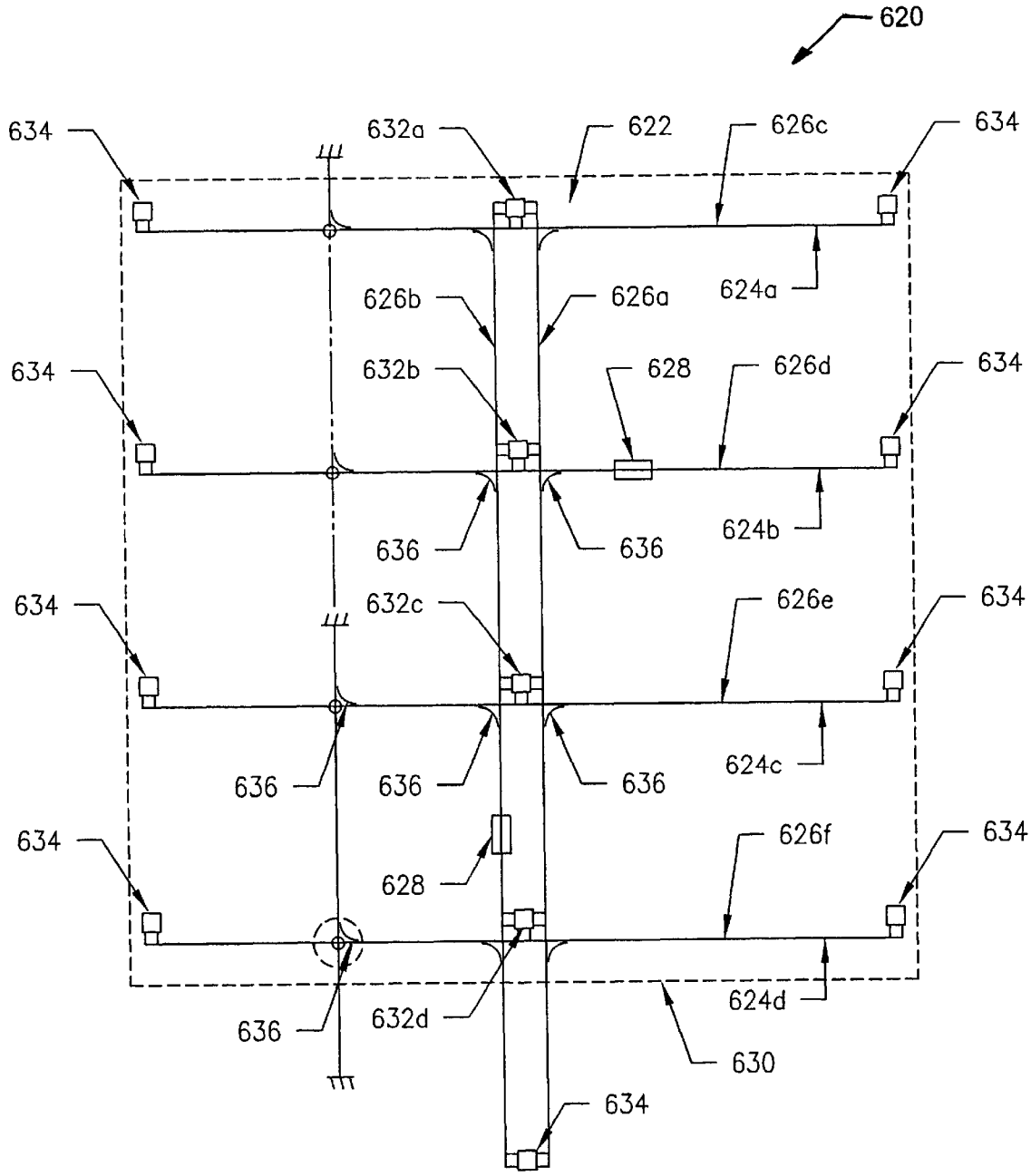
FIG. 12 is a somewhat schematic top plan view of a fifth embodiment of a transportation system of the present invention.

Referring now to FIG. 12, depicted at 620 therein is yet another transportation system constructed in accordance with the principles of the present invention. The system 620 is constructed and operates in a manner that, in many respects, is similar to that of the transportation systems described above. The system 620 thus will be discussed below only to the extent necessary for a complete understanding of the present invention.

The transportation system 620 comprises a main line 622 and a plurality of cross lines 624. The main line 622 comprises a pair of cables 626, while the cross lines each comprise a single cable 626. Suspended from the cables 626 are one or more trolley assemblies 628. The trolley assemblies 628 traverse the cables 626 to allow loads to be transported through the area 630 serviced by the system 620.

The main line 622 comprises a plurality of juncture posts 632 located at the junctures between the main line 622 and the cross lines 624. Spar trees 634 are located at each end, and may be spaced at intervals as necessary along, of the cross lines 624. Associated with each of the juncture posts 632 are one or more transfer tracks 636.

Figure 13:
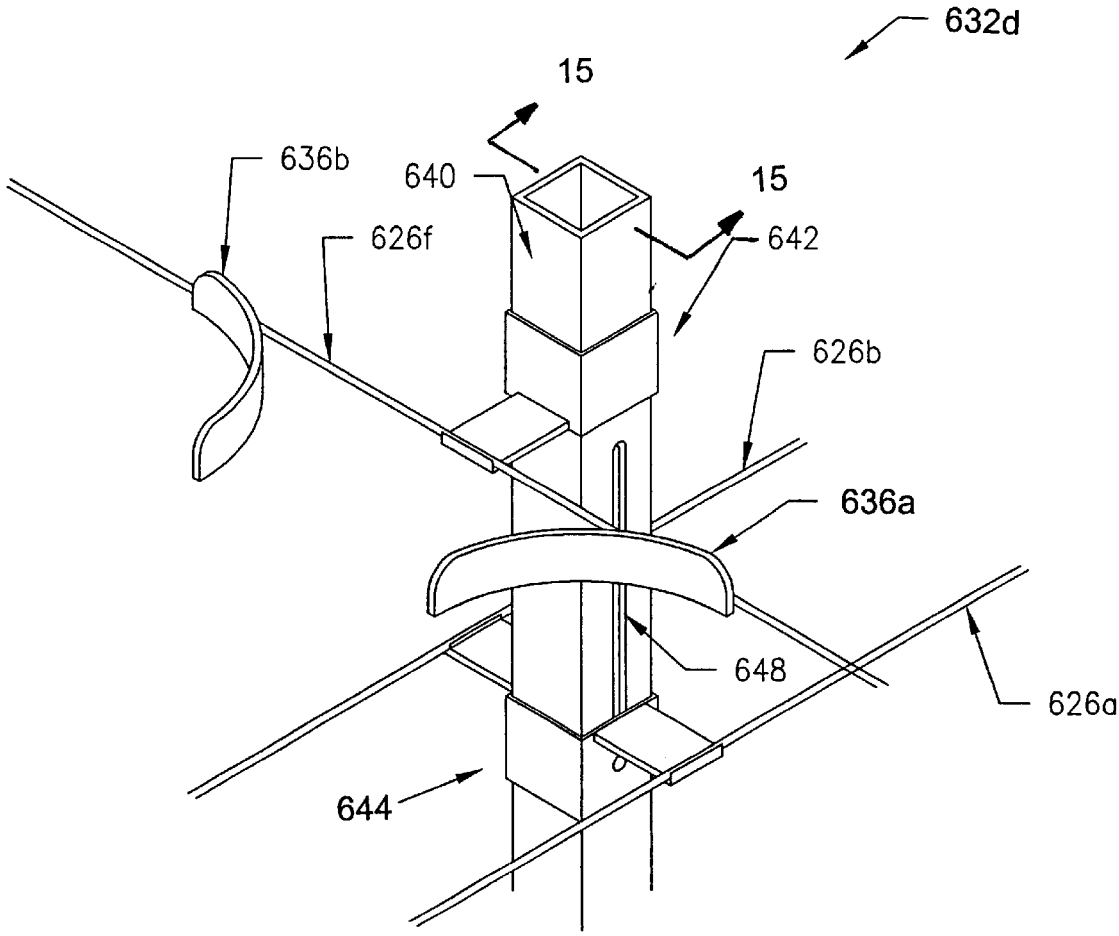
FIG. 13 is perspective view of a juncture post employed by the transportation system of FIG. 12 in a bypass configuration.
Figure 14:
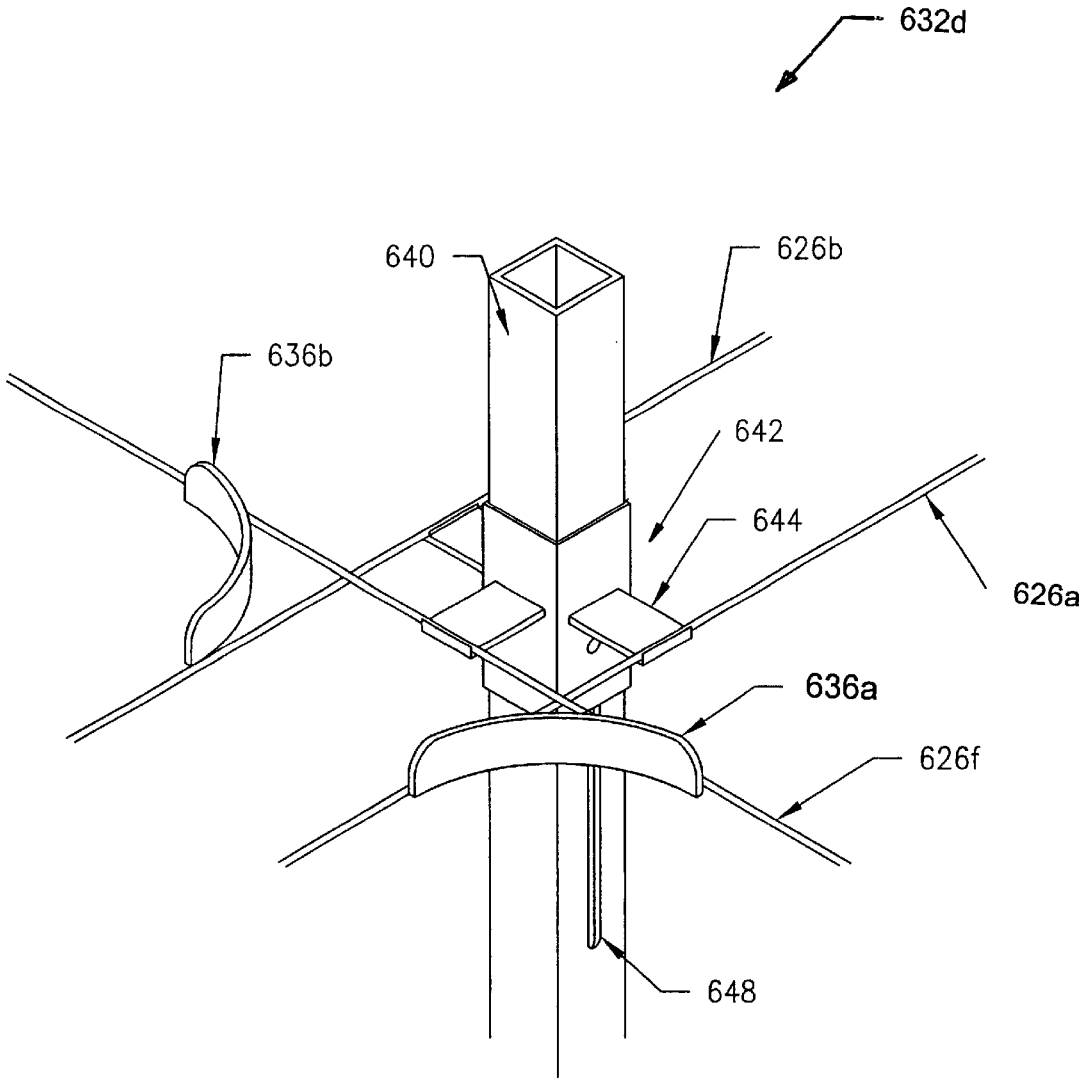
FIG. 14 is similar to FIG. 13 but depicts the juncture post in a transfer configuration.
Figure 15:
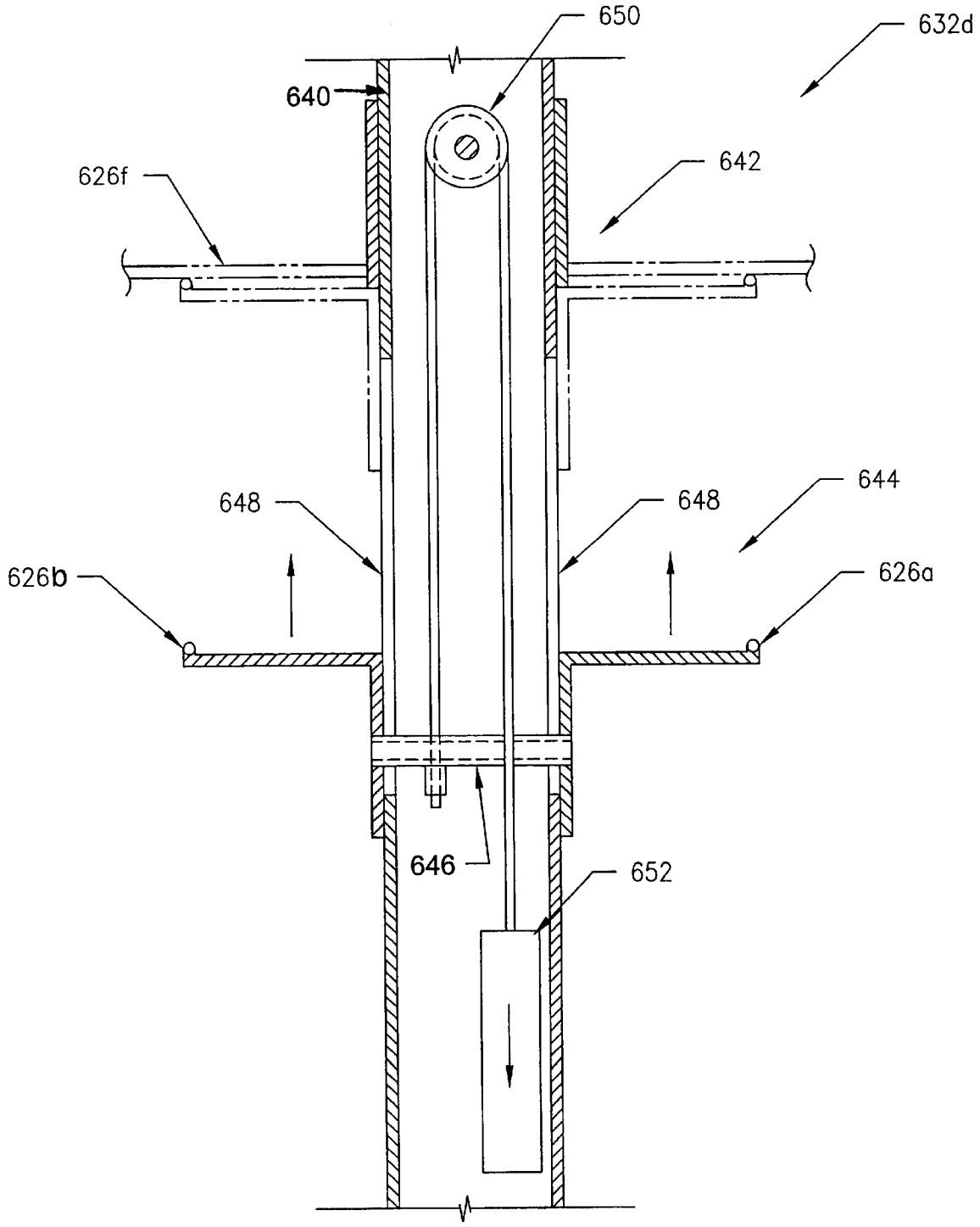
FIG. 15 is a somewhat schematic section view of the exemplary juncture post taken along lines 15—15 in FIG. 13.
Figure 16:
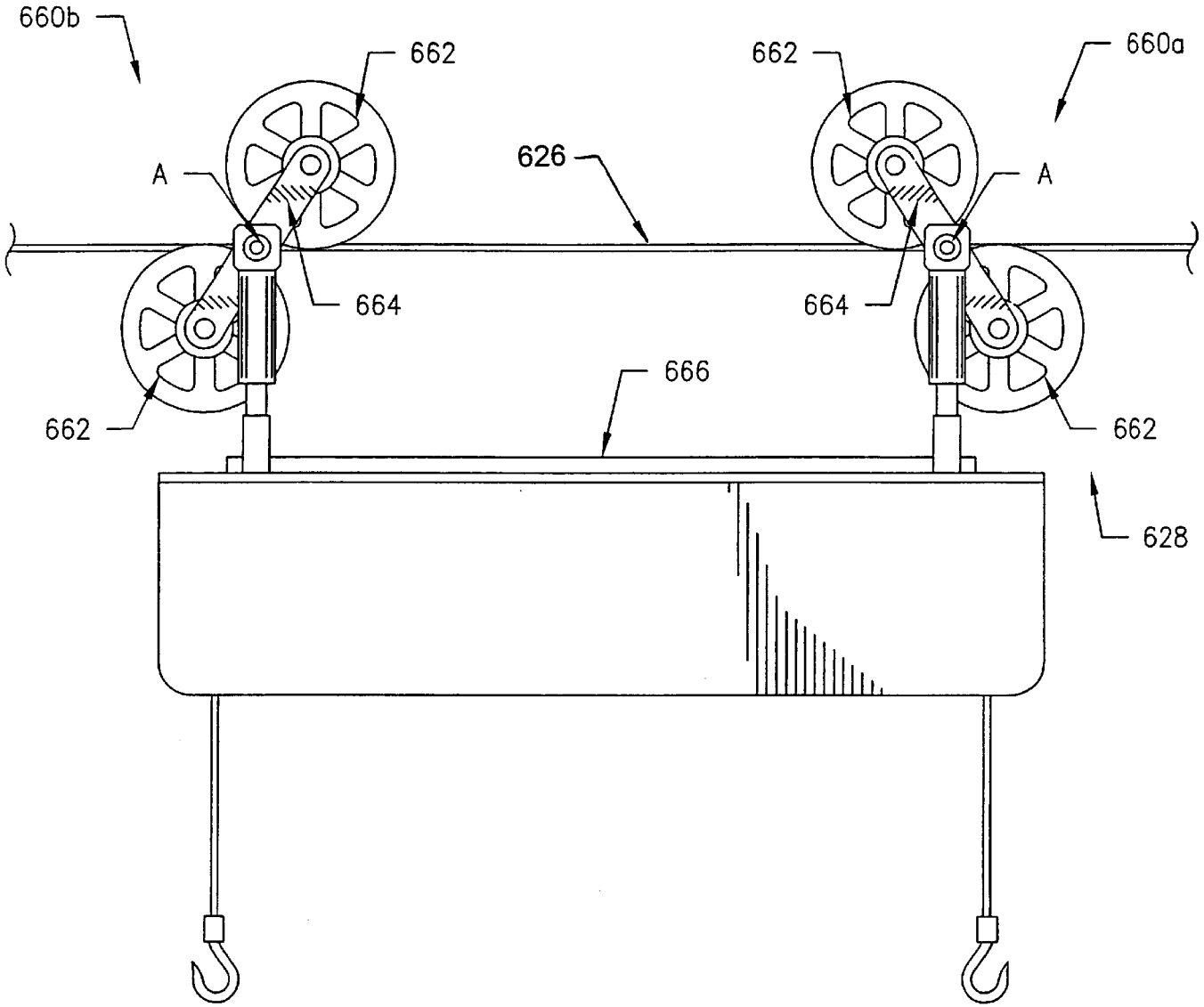
FIG. 16 is a front elevation view depicting an exemplary trolley assembly that may be used with the transportation systems of the present invention, where the trolley assembly is shown with its wheel assemblies in a traversing configuration in FIG. 16.
Figure 17:
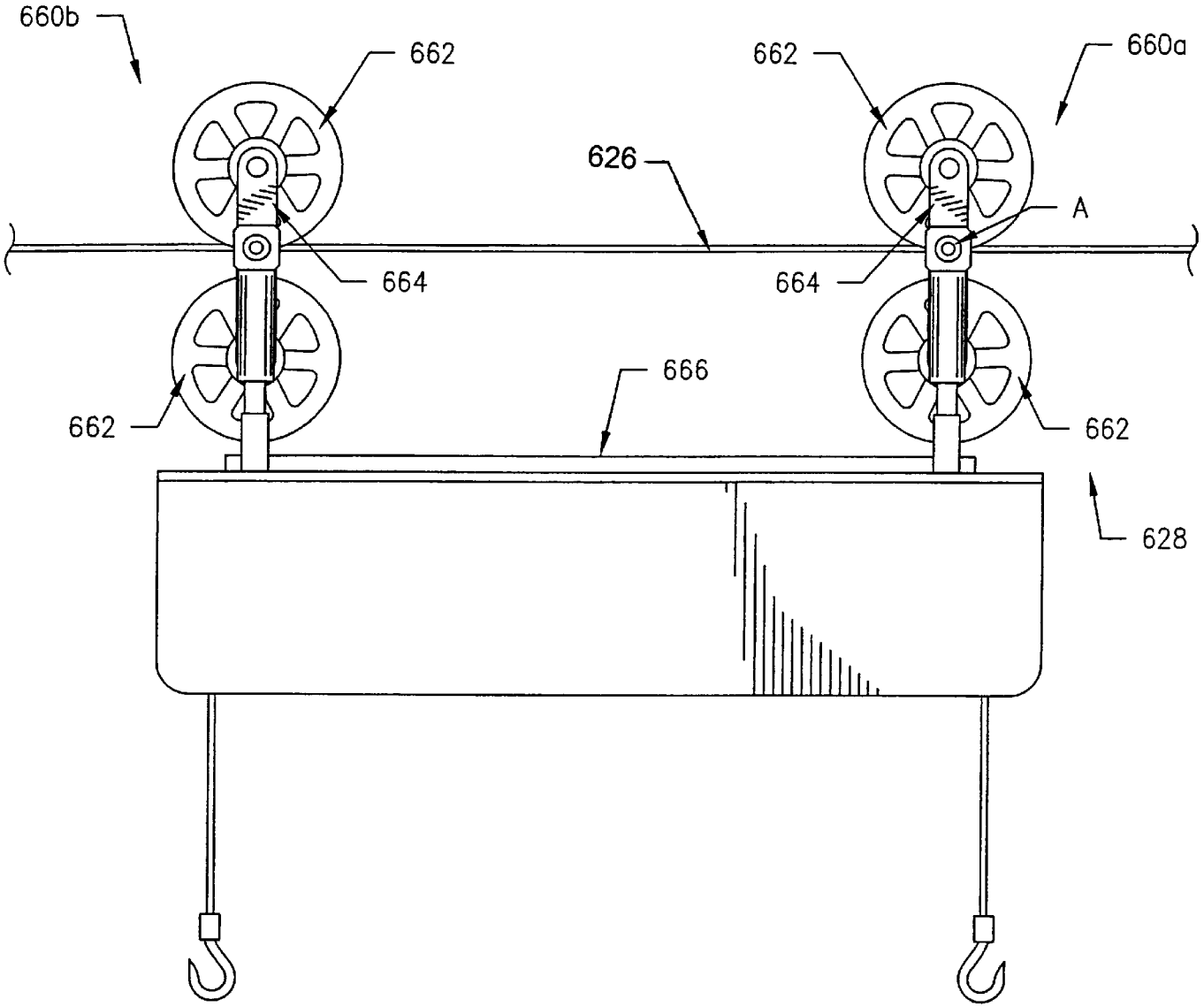
FIG. 17 is similar to FIG. 16, but the wheel assemblies of the trolley assembly are in a turn configuration.

Referring now to FIGS. 13–15, the juncture posts 632 will now be discussed in further detail. The juncture posts 632 comprise a post member 640, an cross support assembly 642, and a main support assembly 644. The cross support assembly 642 supports the cable 626 that forms the cross line 624 and is fixed at a predetermined location on the post member 640. The main support assembly 644 supports the cables 626 that form the main line 622 and moves between a lower position (FIG. 13) and an upper position (FIG. 14).

First and second transfer tracks 636*a* and 636*b* are suspended from the cross line 624. When the main support assembly 644 is in the lower position, the transfer tracks 636 are suspended above the cables 628 forming the main line 622; the cross line 624 and transfer tracks 636*a* and 636*b* thus do not interfere with movement of the trolley assemblies 628 along the main line 622 with the main support assembly 644 in its lower position. When the main support assembly 644 is in the upper position, the transfer tracks 636 engage the cables 628 forming the main line 622. When the transfer tracks 636 engage the main line 622, the trolley assemblies 628 can transfer between the main line 622 and the cross line 624.

As shown in FIG. 15, the exemplary main support assembly 644 comprises a pin 646 that extends through slots 648 in the post member 640. As depicted in FIG. 15, a lifting force is applied to the pin 646 to cause the main support assembly 644 to move from the lower position to the upper position. This lifting force may be applied by a motor connected to a pulley assembly schematically indicated by a pulley 650, but other lifting means such as a screw jack, hydraulic actuator, or the like may be used depending upon the circumstances. The lifting force may also be assisted by a biasing means such as a counterweight assembly 652, but other biasing means such as torsion spring or the like may be used. In addition, a locking means may be used to lock the main support assembly 644 to the post member 640 in the upper position.

The design and control of an appropriate lifting means, biasing means, and locking means would be routine to one of ordinary skill in the art given the particular circumstances in which the transportation system 620 is to be used. The lifting means, biasing means, and locking means thus may be implemented using any structure appropriate for the particular circumstances.

Referring now to FIGS. 16–18 and 20, depicted therein is a trolley assembly 628 that may be used in the exemplary transportation system 620 or any of the other transportation systems disclosed herein. The trolley system 628 comprises a pair of wheel assemblies 660 each comprising a pair of main wheels 662 mounted on a wheel bar 664. Suspended from the wheel assemblies 660 is a carriage assembly 666 adapted to support the load to be transported by the system 620. The wheel assemblies 660 pivot about a horizontal axis A (FIGS. 16 and 17) and a vertical axis B (FIG. 18) relative to the carriage assembly 666. The wheel bar defines what will be referred to as the closed side 668 of the carriage assembly 666; the relevance of the closed side 668 will become apparent from the following discussion.

An actuator (not shown) forces the wheel assemblies 660 to pivot about the horizontal axis A between a traction position (FIG. 16) in which both main wheels 662 engage the cable 626 and a bypass position (FIG. 17) in which only the uppermost of the main wheels 662 engages the cable 626. The traction position places a reverse bend in the cable 626 that enhances the ability of the wheel assemblies 660 to move the trolley assembly 628 along the cable 626. The traction position helps avoid slippage between the powered main wheels 662 and the cable 626 when the trolley assembly 628 is going up or down hill. The bypass position allows the trolley assembly 628 to traverse the cables 626 where they are supported by the support assemblies 642 and 644.

Figure 18:
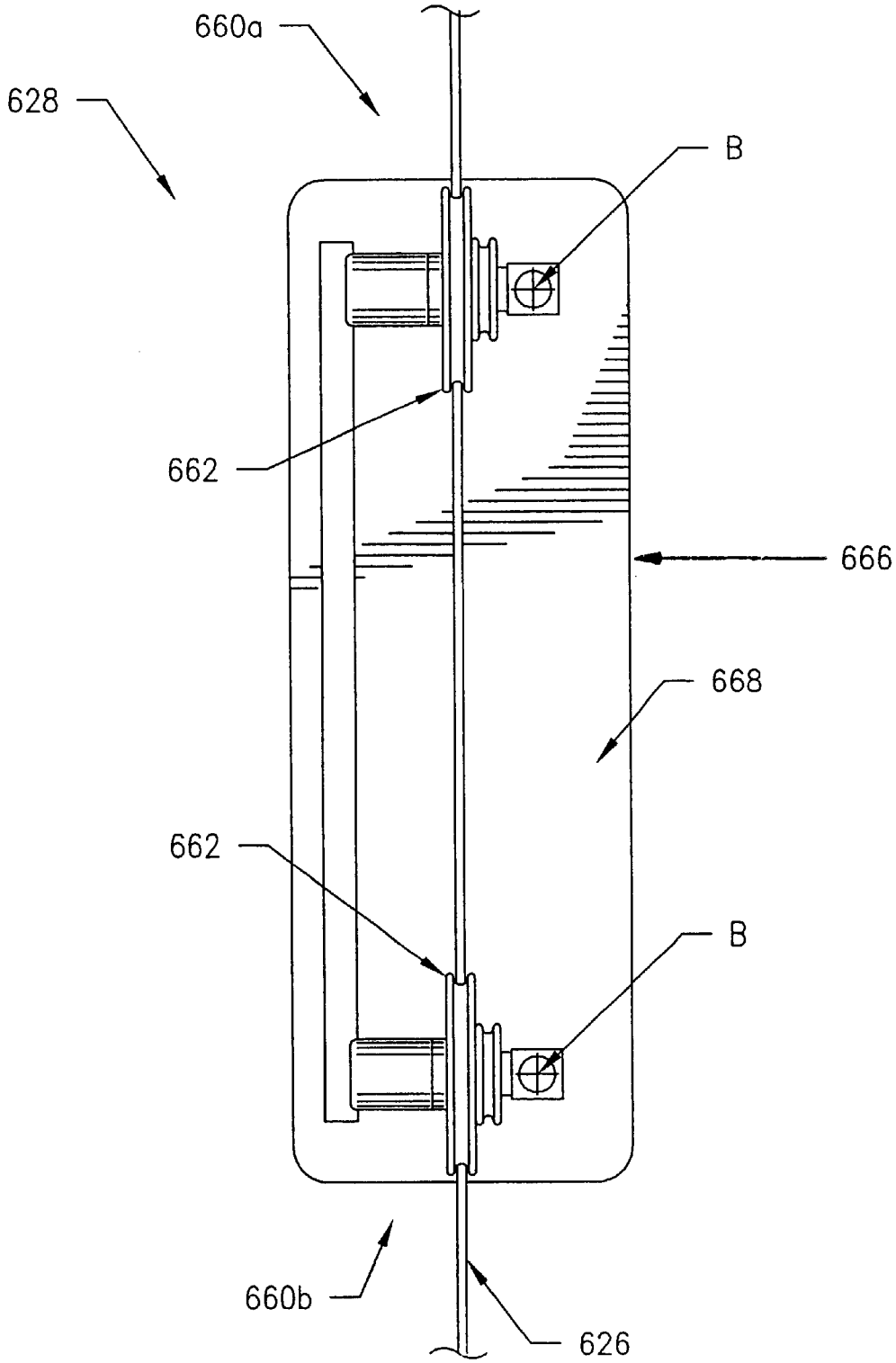
FIG. 18 is a top plan view of the trolley assembly of FIG. 16 with its wheel assemblies in an aligned configuration.
Figure 20:
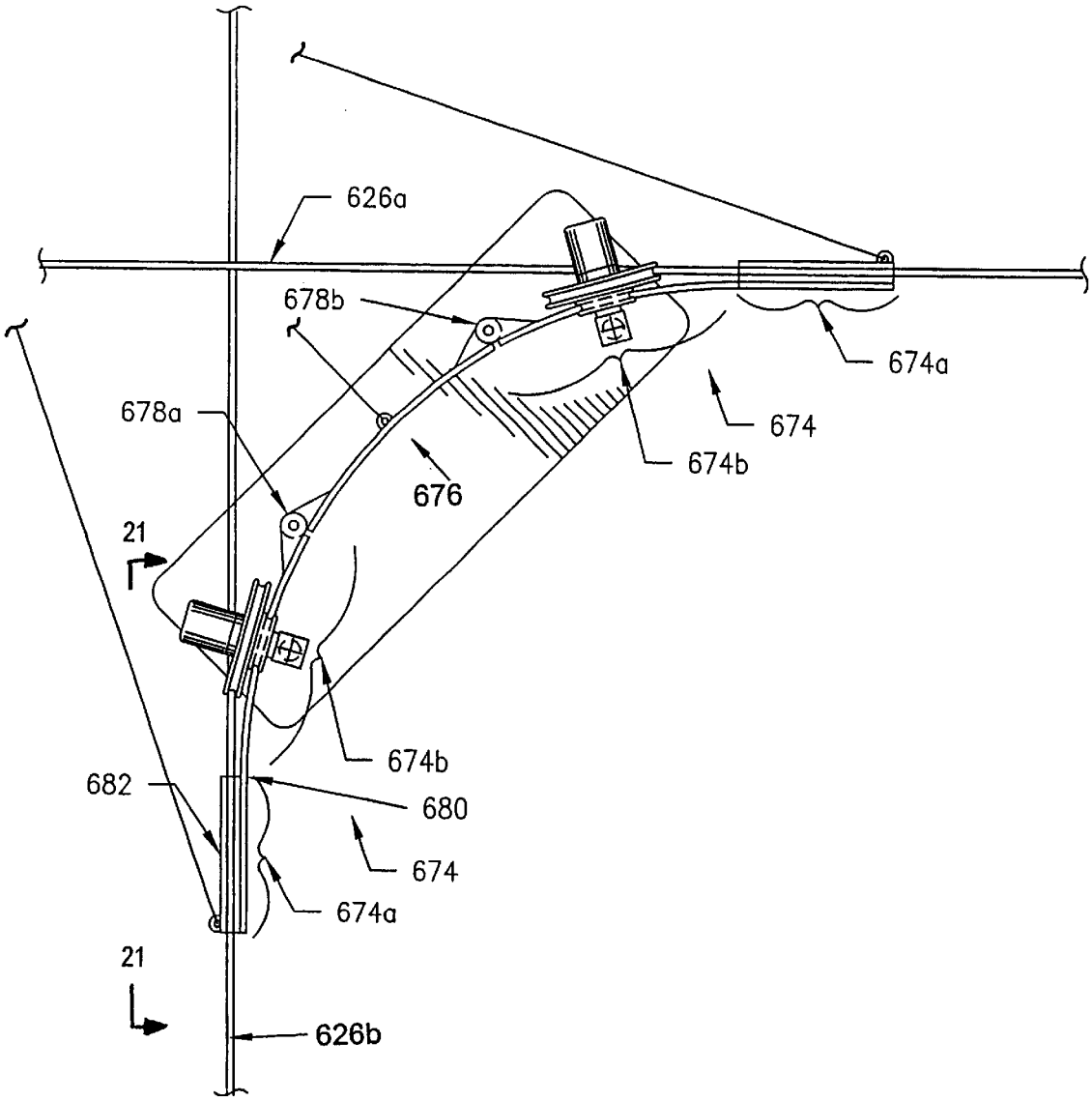
FIG. 20 is a top plan view depicting details of an exemplary transfer track of the present invention.
Figure 21:
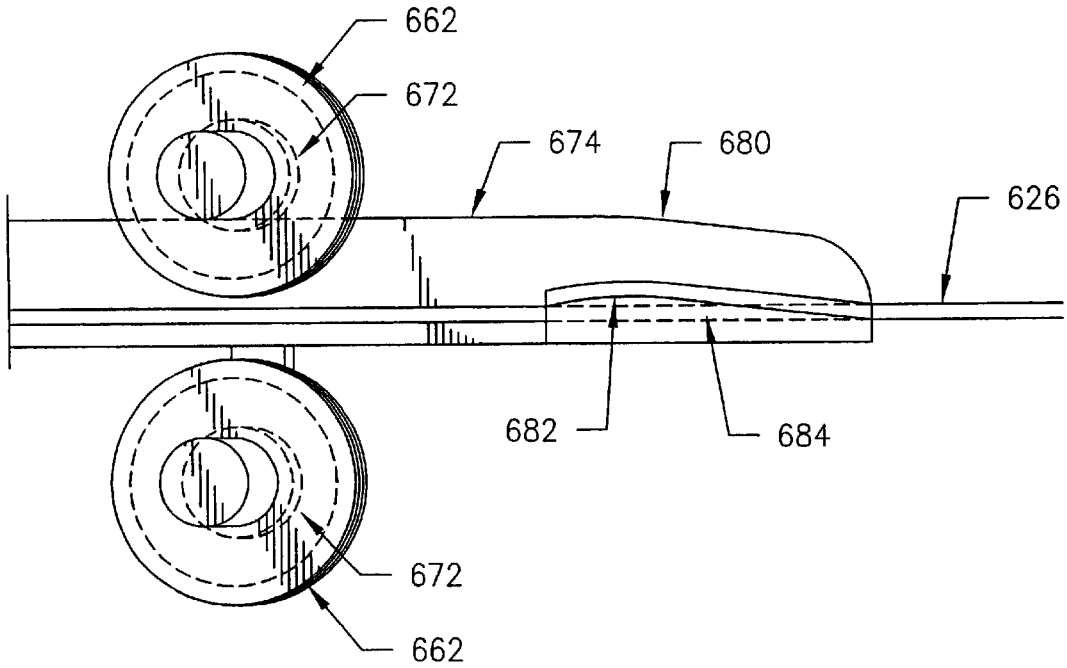
FIG. 21 is a side elevation cut-away view taken along lines 21—21 in FIG. 20.
Figure 22:
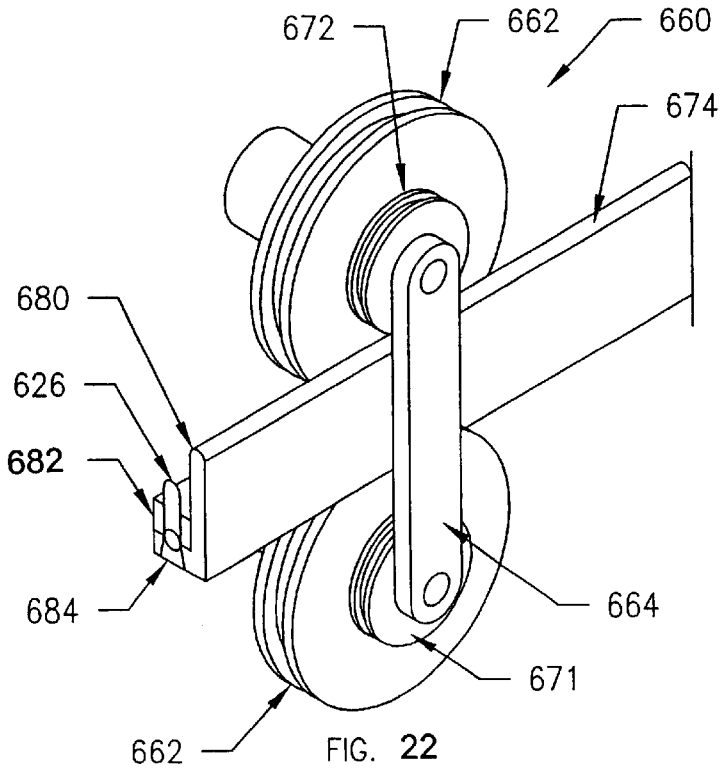
FIG. 22 is a front elevation view of the transfer track of FIG. 20.

Comparing FIGS. 18 and 20 illustrates that the wheel assemblies 660 freely rotate about the vertical axes B between a cable position (FIG. 18) in which the trolley assembly 628 traverses one of the cables 626 and a turning position (FIG. 20) in which the trolley assembly 628 transfers from one cable 626 to another across one of the transfer tracks 636.

Figure 19:
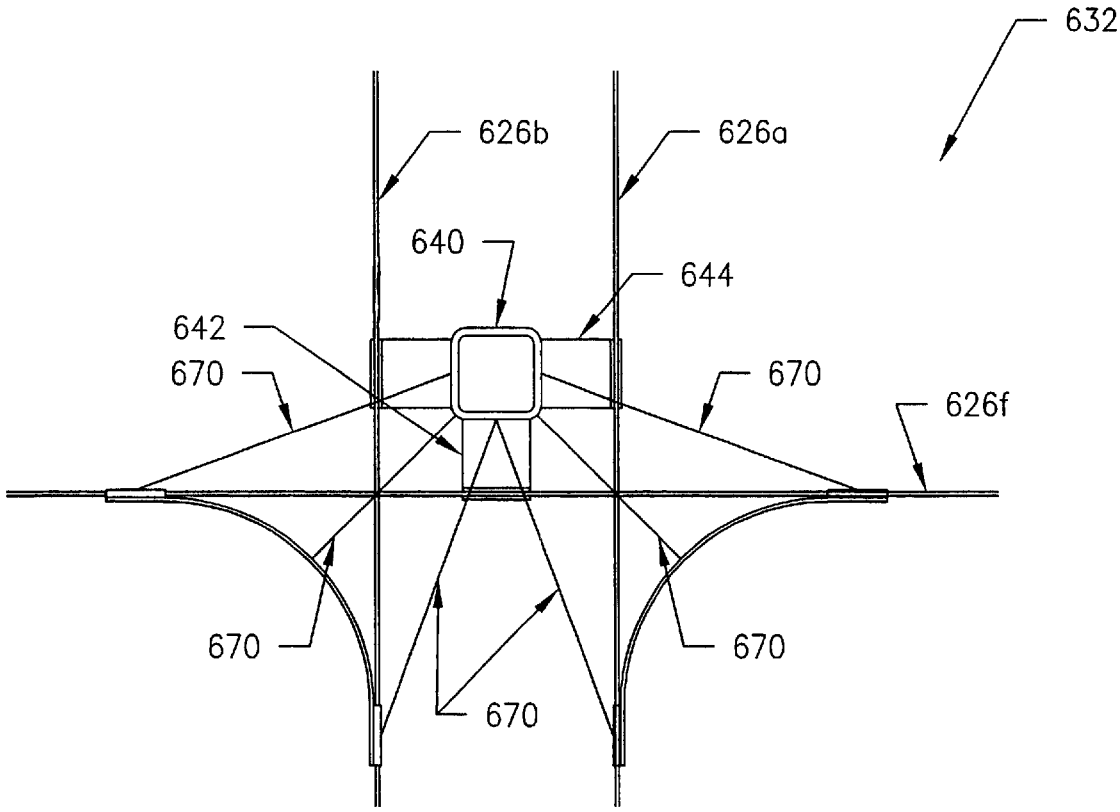
FIG. 19 is a top plan view of the juncture post of FIG. 13 depicting bracing cables connected between the juncture post and the transfer tracks.

Referring for a moment to FIG. 19, it can be seen that bracing cables 670 extend between the transfer tracks 636 and the cross support assembly 642. The bracing cables 670 maintain the transfer tracks 636 in a generally horizontal configuration, especially when the main support assembly 644 is in its lower position.

Referring now back to FIGS. 20–23, the wheel assemblies 660 and transfer track 636 will now be described in further detail.

The wheel assemblies 660 each comprise, in addition to the main wheels 662 described above, a transfer wheel 672. The diameter of the exemplary transfer wheels 672 is smaller than that of the main wheels 662, and the transfer wheels 672 are coaxially mounted adjacent to the main wheels 662.

The exemplary transfer track 636 comprises end segments 674 and a center segment 676. The end segments 674 are similar but are mirror images of each other. Each comprises a substantially straight cable portion 674*a* and a transfer portion 674*b* that extends along an arc spanning approximately thirty degrees. The center segment 676 also extends along an arc of approximately thirty degrees. The end segments 674 are connected by hinges 678*a* and 678*b* to the center segment 676 to the allow slight movement of these segments 674 and 676 relative to each other.

As discussed above, the transfer track 636 is configured to allow the trolley assembly 628 to transfer between first and second cables 626*a* and 626*b* arranged at substantially a right angle to each other. The movement between the track segments 674 and 676 allows the transfer track 636 to accommodate cables that cross at angles slightly greater or less than ninety degrees, which may be common in practice.

The end track segments 674 comprise a rail 680 and a cable plate 682. The cable plate 682 defines a cable groove 684 that receives the cable 626. The cable groove 684 aligns the cable 626 with the straight cable portion 674*a*.

The rail 680 extends up from the cable plate 682 on what will be referred to herein as the inside 688 of the transfer track 636. The relationship of the inside 688 of the transfer track 636 to the closed side 668 of the trolley assembly 628 is important to understanding the operation of the transportation system 620. As will be described in further detail below, the closed side 668 of the trolley assembly 628 must be on the inside of the transfer track 636; otherwise, the cables 626 will interfere with wheel bar 664 and prevent movement of the trolley assembly 628.

The arrangement of the rail 680 relative to the cable groove 684 aligns the transfer wheels 672 with the rail 680 as the lead wheel assembly 660 moves along the cable portion 674*a* of the end segments 674. The height of the rail 680 relative to the cable plate 682 increases towards the transfer portion 674*b* of the end segments 674. Accordingly, the transfer wheels 672 engage the rail 680 such that the load carried by the trolley assembly 628 is gradually transferred from the cable wheels 662 to the transfer wheels 672 as the lead wheel assembly 660 moves along the cable portion 674*a*. The cable wheels 662 are thus suspended as the wheel assemblies 660 traverse the center segment 676 and the transfer portions 674*b* of the end segments 674. The lower transfer wheels 672 engage the underside of the rail 680 to obtain additional purchase when necessary.

Figure 23:
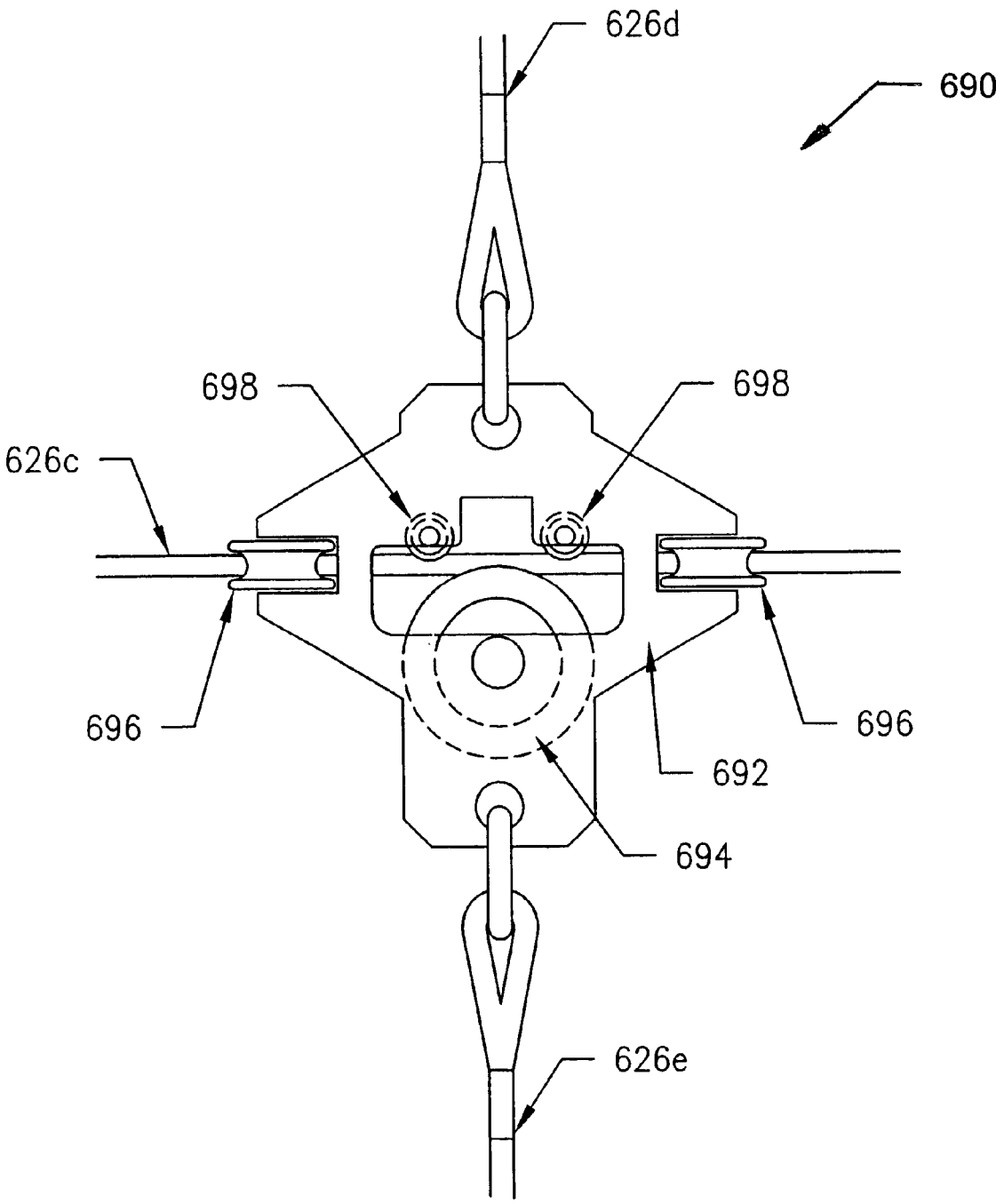
FIG. 23 is a top plan view of a block assembly that may be used as part of the transportation system of FIG. 12.

Referring now to FIG. 23, depicted at 690 therein is a block assembly that may be used by the transportation system 620 or any of the other transportation systems described herein. The block assembly 690 is adapted to traverse one cable 626*c* and support the end of another cable 626*d*. A snubber cable 626*e* is attached to the block assembly 620 to apply a counterforce to the cable 626*d*. The block assembly 690 thus counterbalances the load applied to the cable 626*c* by the cable 626*d* and ensures that these cables 626*c* and 626*d* extend from each other at close enough to a right angle for proper functioning of the transfer track 636.

The exemplary block assembly 690 comprises a housing 692 on which is mounted a main bearing wheel 694, a pair of lateral bearing wheels 696, and a pair of guide wheels 698. The cables 626*d* and 626*e* are attached to the housing 692. The main bearing wheel 694 transfers horizontal loads from the cable 626*d* to the cable 626*c*. The lateral bearing wheels 696 transfer vertical loads from the cables 626*d* and 626*e* to the cable 626*c*. The guide wheels 698 transfer horizontal loads from the cable 626*e* to the cable 626*c* and ensure that the block assembly 690 is connected to the cable 626*c* under slack conditions.

In use, the block assemblies 690 are used to connect a feeder cable 626 between two cross lines 624 to enhance coverage of the area 630 serviced by the system 620.

VIII. Sixth Embodiment

Figure 24:
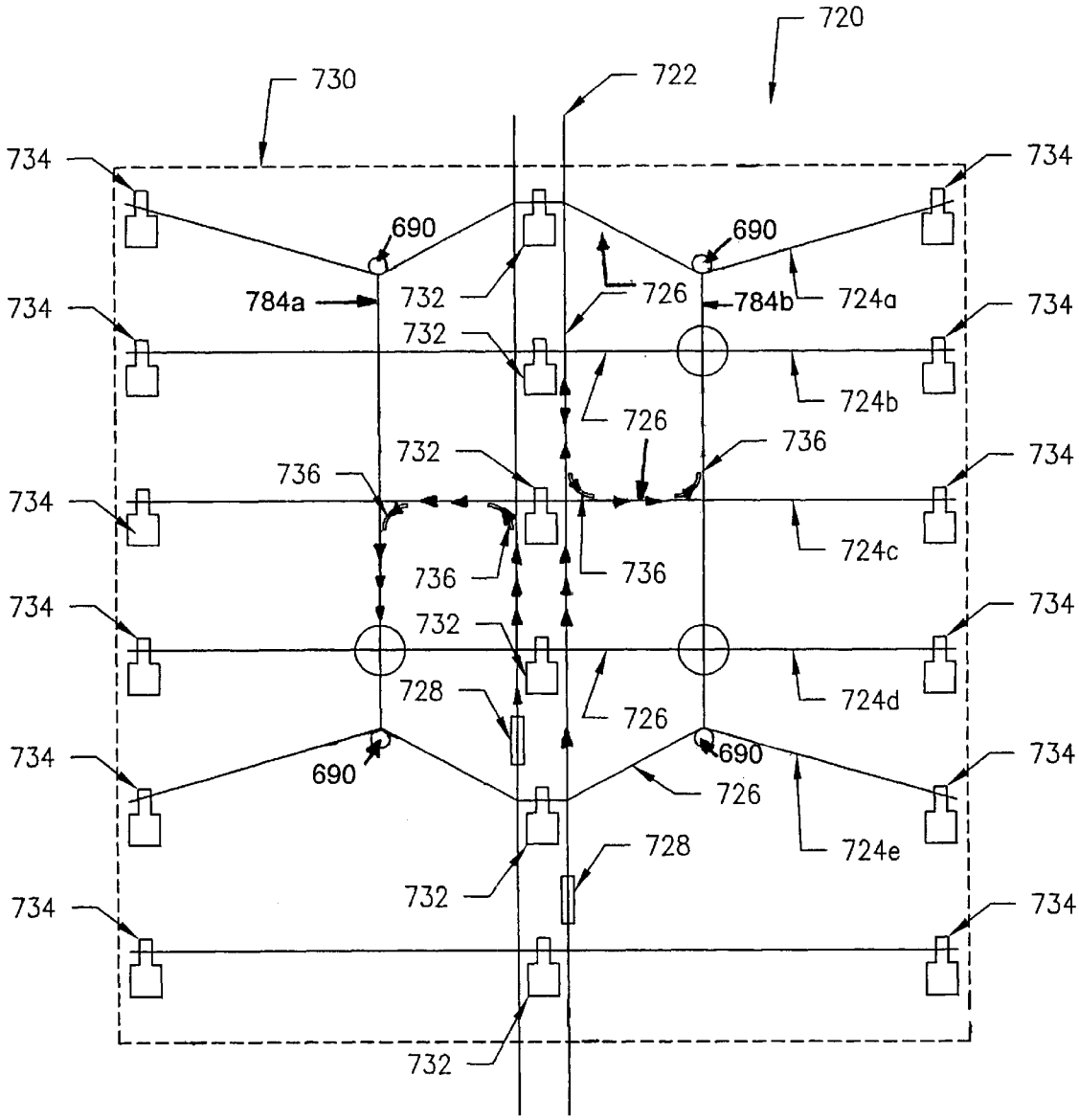
FIG. 24 is a somewhat schematic top plan view of a sixth embodiment of a transportation system of the present invention.

Referring now to FIG. 24, depicted at 720 therein is yet another transportation system constructed in accordance with the principles of the present invention. The system 720 is constructed and operates in a manner that, in many respects, is similar to that of the transportation systems described above, and in particular the system 620. The system 720 thus will be discussed below only to the extent necessary for a complete understanding of the present invention.

The transportation system 720 comprises a main line 722 and a plurality of cross lines 724. The main line 722 comprises a pair of cables 726, while the cross lines each comprise a single cable 726. Suspended from the cables 726 are one or more trolley assemblies 728. The trolley assemblies 728 traverse the cables 726 to allow loads to be transported through the area 730 serviced by the system 720.

The main line 722 comprises a plurality of juncture posts 732 located at the junctures between the main line 722 and the cross lines 724. Spar trees 734 are located at each end, and may be spaced at intervals as necessary along, of the cross lines 724. Associated with each of the juncture posts 732 are one or more transfer tracks 736.

Figure 25:
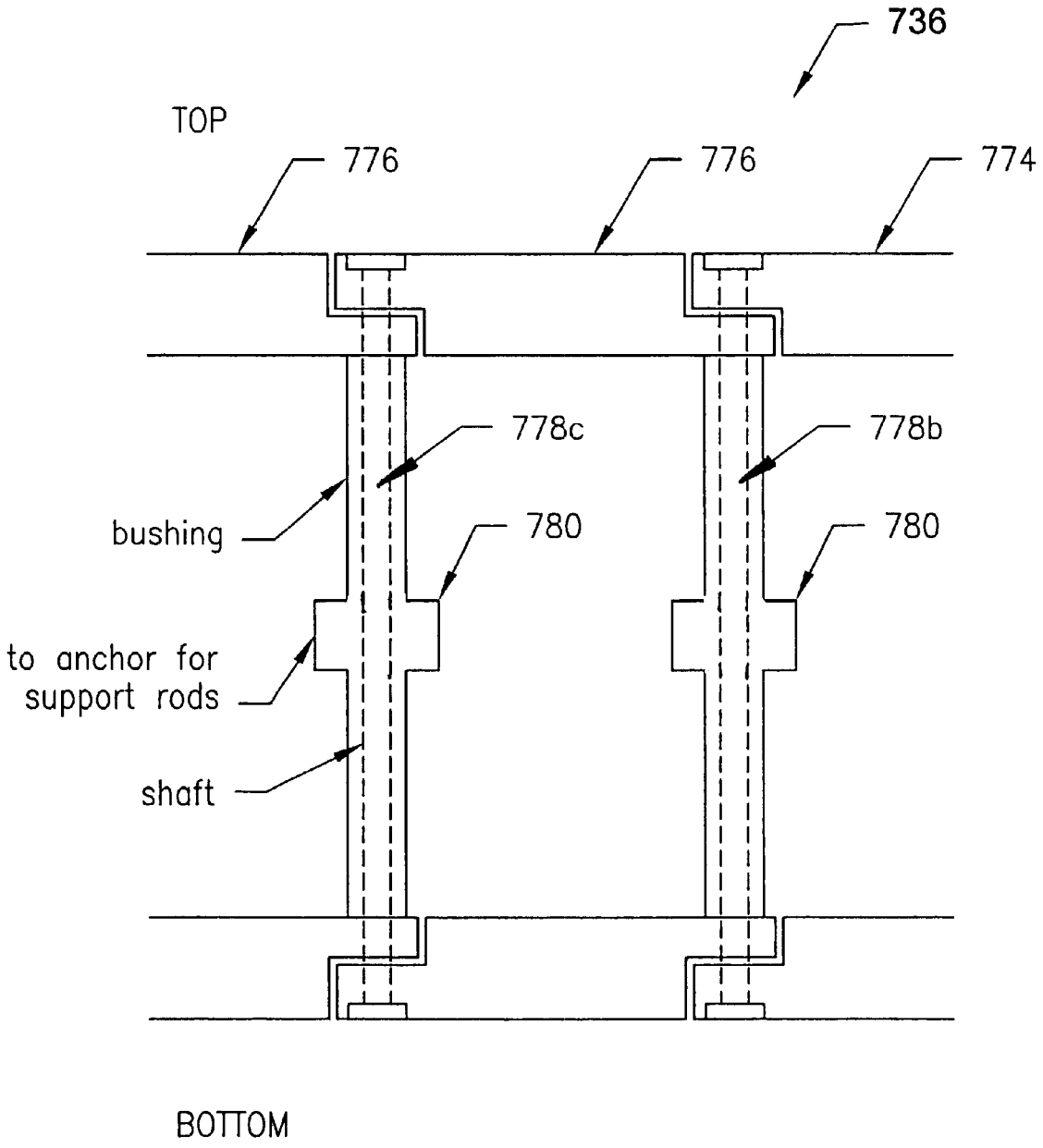
FIG. 25 is a top plan view of a double winch block assembly that may be used in the system of FIG. 24.
Figure 26:
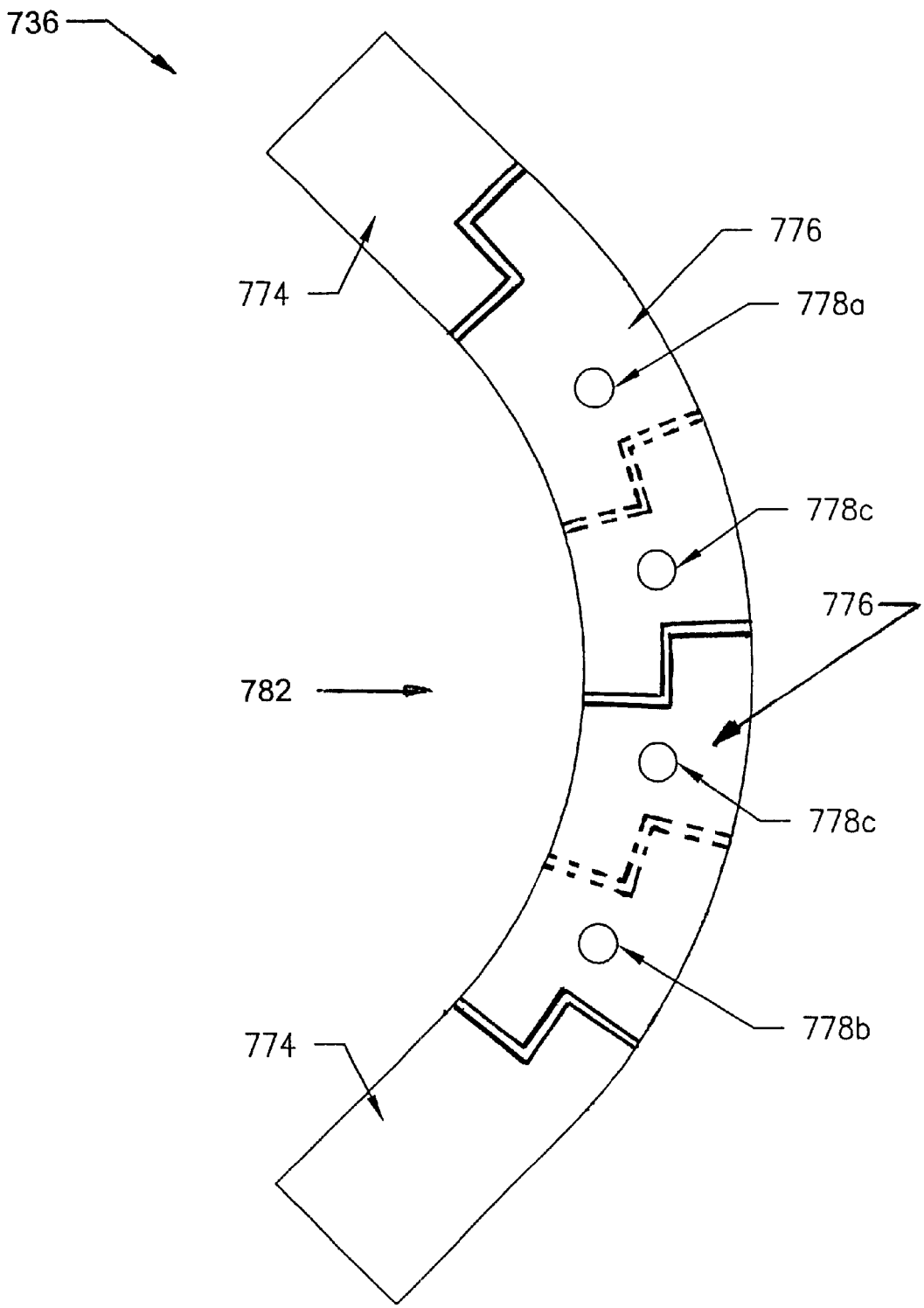
FIG. 26 is a partial, side elevation view of an exemplary transfer track of the present invention.

Referring now to FIGS. 25 and 26, the exemplary transfer track 736 comprises end segments 774 and at least one center segment 776. The end segments 774 are mirror images of each other and define a straight path that is substantially aligned with the cable 726. The center segments 776 extend along a portion of an arc such that the total arc spanned by the segments 776 equals approximately ninety degrees. The end segments 774 are connected by hinges 778*a* and 778*b* to the center segments 776 to the allow slight movement of these segments 774 and 776 relative to each other. The center segments 776 are in turn connected to each other by hinges 778*c* that allow slight movement of these center segments 776 relative to each other.

Referring to FIG. 25, it can be seen that the exemplary center segments 776 have an I-beam configuration that strengthens the transfer track 736. Openings 780 are formed between the segments 776 to allow braces to be connected to the track 736 which extend back under the cables 726 to stabilize the transfer track 736.

As discussed above, the transfer track 736 is configured to allow the trolley assembly 728 to transfer between first and second cables 726*a* and 726*b* arranged at substantially a right angle to each other. The movement between the track segments 774 and 776 allows the transfer track 736 to accommodate cables that cross at angles slightly greater or less than ninety degrees, which may be common in practice.

The inside of the transfer track 736 is identified by reference character 782 in FIG. 26. The relationship of the inside 782 of the transfer track 736 to the closed side 768 of the trolley assembly 728 is also important in the context of the transportation system 720.

In particular, the trolley assembly 728 can traverse the transfer track 736 only when the closed side thereof is on the inside 782 of the transfer track 736. Accordingly, if a trolley assembly 728 is on the rightmost cable 726*a* and must be turned right onto one of the cross lines 724 and then right again onto a harvest line 784, this can be accomplished easily.

If, however, a trolley assembly 728 is on the rightmost cable 726*a* and must be turned right onto one of the cross lines 724 and then left onto the harvest line 784, the trolley assembly 728 must move past the appropriate cross line 724 and the transfer track 736 rearranged to be on the same side of the cross line 724 as the trolley assembly 728. The trolley assembly 728 then moves onto the cross line 724 and is on the inside of the transfer track 736 arranged to allow the trolley assembly 728 to turn left onto the harvest line 784*a*.

In this context, it may be practical to employ a bi-directional transfer track assembly having two transfer tracks. Such a bi-directional transfer track assembly would not need to be rearranged from one side to the other of the cross line 724 as would be the case with a single transfer track.

Referring for a moment back to FIG. 24, it can be seen that cross lines 724*a* and 724*e* support the ends of the harvesting lines 784*a* and 784*b*. Arranged at each end of the harvesting lines 784*a* and 784*b* are block assemblies such as the block assembly 690 described above. In the exemplary system 720, no snubber lines are connected to the ends of the harvesting lines 784*a* and 784*b*, so the cross lines 724*a* and 724*e* deflect as illustrated.

Figure 27:
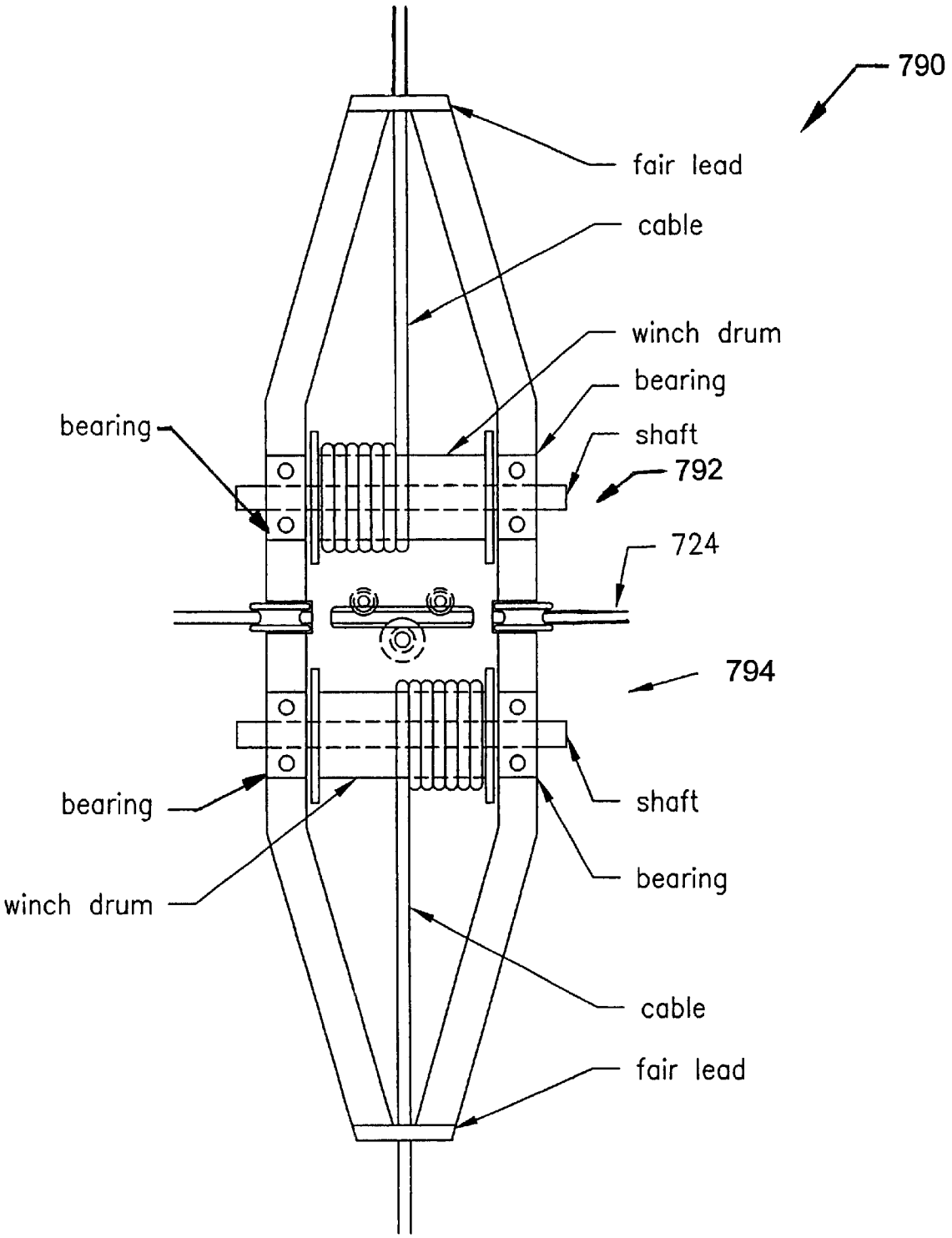
FIG. 27 is a top plan view of the transfer track of FIG. 26.

At the junctures of the harvesting lines 784*a* and 784*b* and cross lines 724*b* and 724*d* are double block assemblies 790. As shown in further detail in FIG. 27, the double block assemblies 790 comprise first and second powered blocks 792 and 794 that allow the operator to adjust the tension on both sides of the cross lines 724*b* and 724*d* to ensure that the harvesting lines 784*a* and 784*b* are substantially perpendicular to the cross lines 784*a* and 784*b*.

From the foregoing, it should be clear that the present invention may be embodied in forms other than those described above.

What is claimed is:

1. A transportation system for transporting a load to and from a served area, the system comprising:

a) a cross support line having first and second ends, the cross support line being suspended above the ground;

b) a first support line which intersects the cross support line;

c) a trolley assembly suspended from the cross support line, the trolley assembly comprising:

i) a first wheel;

ii) a second wheel;

iii) a motor for rotating at least one of the first wheel and the second wheel to cause the trolley assembly to move between the first end of the cross support line and the second end of the cross support line;

iv) a load bearing assembly for engaging the load so that the load can be transported along the cross support line, the load bearing assembly being a hoist assembly for raising and lowering raw timber;

v) a structural member from which the load bearing assembly is suspended and to which the first and second wheels are rotatably attached;

vi) an equipment platform mounted to the structural member, where the equipment platform supports a generator for providing energy to the motor;

wherein the cross support line from which the trolley assembly is suspended extends under the first wheel and over the second wheel and the second wheel is attached to the structural member between the first wheel and the load bearing assembly;

d) a transfer assembly adapted to engage the cross support line and the first support line to allow the trolley assembly to move between the cross support line and the first support line and along the first support line, the transfer assembly comprising a plurality of segments pivotably joined together such that the transfer assembly accommodates a range of angles between the cross support line and the first support line; and e) a post assembly comprising:

i) a fixed support member configured to support at least a portion of the first support line; and ii) a movable support member configured to support at least a portion of the cross support line, where the movable support member is movable to raise and lower the cross support line at the post assembly.

* * * * *